US009592454B2

(12) United States Patent
Weston et al.

(10) Patent No.: US 9,592,454 B2
(45) Date of Patent: Mar. 14, 2017

(54) INTERACTIVE WATERSLIDE SYSTEM AND METHOD

(71) Applicant: WHITEWATER WEST INDUSTRIES LTD., Richmond, British Columbia (CA)

(72) Inventors: Denise Chapman Weston, Wakefield, RI (US); Aaron Mendelson, Longmont, CO (US)

(73) Assignee: Whitewater West Industries Ltd., Richmond, BC (CA)

( * ) Notice: Subject to any disclaimer, the term of this patent is extended or adjusted under 35 U.S.C. 154(b) by 0 days.

(21) Appl. No.: 14/540,858

(22) Filed: Nov. 13, 2014

(65) Prior Publication Data

US 2015/0133229 A1 May 14, 2015

Related U.S. Application Data

(60) Provisional application No. 61/903,863, filed on Nov. 13, 2013.

(51) Int. Cl.
*A63G 21/18* (2006.01)

(52) U.S. Cl.
CPC ..... *A63G 21/18* (2013.01)

(58) Field of Classification Search
CPC ..... A63G 21/18
See application file for complete search history.

(56) References Cited

U.S. PATENT DOCUMENTS

| | | | | |
|---|---|---|---|---|
| 3,871,042 | A | 3/1975 | Farmer | |
| 5,453,054 | A * | 9/1995 | Langford | A63G 21/18 405/79 |
| 6,375,578 | B1 | 4/2002 | Briggs | |
| 6,527,646 | B1 | 3/2003 | Briggs | |
| 7,905,790 | B2 | 3/2011 | Schnuckle | |
| 7,967,692 | B2 | 6/2011 | Werner | |
| 8,079,916 | B2 * | 12/2011 | Henry | A63G 3/02 472/117 |
| 9,138,653 | B2 | 9/2015 | Heaven et al. | |
| 2007/0087850 | A1 | 4/2007 | Henry et al. | |
| 2007/0131155 | A1 | 6/2007 | Dingel | |
| 2008/0014835 | A1 | 1/2008 | Weston | |

(Continued)

FOREIGN PATENT DOCUMENTS

| | | |
|---|---|---|
| CA | 2890889 | 5/2014 |
| WO | WO2014075027 | 5/2014 |

*Primary Examiner* — Michael Dennis
(74) *Attorney, Agent, or Firm* — Greenberg Traurig LLP

(57) ABSTRACT

An interactive amusement attraction capable of sensing ride vehicle or user interaction or position. The attraction can track user performance and/or location, through use of a ride vehicle or without, and can include a slide for supporting water and a sensor connected with the slide for sensing an interactive element. The tags or interactive element may be passive (e.g., sensed by the sensor merely when within a predetermined proximity) or may require user manipulation (e.g., a button to be pressed when within a predetermined proximity of the sensor). Various lighting elements may be connected or embedded in the slide and may be controlled to illuminate with various colors. These lighting elements, such as LED light strips, can be used to indicate the presence of a sensor and/or that a sensor has been successfully or unsuccessfully interacted with.

8 Claims, 19 Drawing Sheets

(56) References Cited

U.S. PATENT DOCUMENTS

| | | | | |
|---|---|---|---|---|
| 2008/0064514 | A1* | 3/2008 | Larsen | A63C 19/10<br>472/94 |
| 2008/0293470 | A1 | 11/2008 | Proud | |
| 2009/0143155 | A1 | 6/2009 | Werner | |
| 2009/0197740 | A1 | 8/2009 | Julskjaer | |
| 2010/0203932 | A1 | 8/2010 | Briggs | |
| 2014/0057524 | A1* | 2/2014 | Teel | A63H 18/02<br>446/175 |
| 2014/0135137 | A1 | 5/2014 | Heaven | |

* cited by examiner

INTERACTIVE WATERSLIDE SYSTEM AND METHOD

CROSS REFERENCE TO RELATED APPLICATIONS

This application claims the benefit of U.S. Provisional Patent Application Ser. No. 61/903,863, filed on Nov. 13, 2013, entitled "ILLUMINATION WATERSLIDE SYSTEM AND METHOD," which is hereby incorporated by reference in its entirety.

BACKGROUND

1. Field

The present invention relates generally to amusement attractions, such as wave machines, or ride vehicles for use on amusement attractions. More particularly, the present invention relates to amusement or water attractions or ride vehicles for use thereon that incorporate one or more inflatable areas or portions.

2. Description of the Related Art

Waterslide attractions typically provide riders with a thrilling experience of speed and lateral force upon the body as the riders slide on the attraction. A stream of water commonly flows along a chute (such as a flume or a tube) from an entrance location of higher elevation to an exit location of lower elevation. A rider slides along the chute due to the stream of water, either with or without a ride vehicle, and experiences the twists, turns, and drops predetermined by the design of the chute. While such attractions provide an initial rush of excitement, repeated riding of the attraction can have diminished appeal as riders become accustomed to the layout of the attraction and their merely passive interaction along its length.

Some concepts or designs have attempted to increase the excitement of a waterslide attraction even after multiple riding attempts. One such concept allowed riders to choose among a collection of preset themes prior to riding on an attraction, the lighting and sound effects changing as the rider traveled down the slide according to the theme chosen by the rider. Depending on the number of selectable themes, riders could have a different experience in subsequent ride attempts. Another concept involved adding elements of competition between two riders via a pair of parallel water slide riding surfaces. These riders could compete with one another on these riding surfaces while non-ride participants could interact with the ride by aiding or hindering the rider movement from platforms positioned adjacent to the riding surfaces. See, for example, U.S. Pat. No. 6,527,646 and U.S. Pat. No. 6,186,902 to Briggs, each incorporated herein by reference in its entirety. While these designs have extended rider excitement more so than conventional water slides without such features, there is still a need and desire for further improvements that provide a more dynamic and entertaining waterslide experience that encourages multiple attempts at riding the water attraction and allows riders to more actively engage with the waterslide.

SUMMARY

Thus, in one embodiment, an improved waterslide is provided having interactive features that challenge the skill or agility of the riders while they navigate the water slide. The improved waterslide would preferably be configured to track user performance, either through the use of a ride vehicle or without, and generate an indication of user performance for encouraging multiple attempts at the waterslide to garner improved performance ratings. Such an improved waterslide would desirably promote competition between riders, even when such riders are not riding on the waterslide at substantially the same time. Moreover, the improved waterslide would desirably allow riders to gauge or analyze their own performance for improving subsequent runs down the waterslide attraction.

In another embodiment, an illuminated water ride attraction is provided that is configured to challenge the skill or agility of users while they navigate along the illuminated water ride attraction, either with or without a water ride vehicle, is disclosed. The illuminated water ride attraction is preferably configured to track user performance and/or location, either through the use of a ride vehicle or without. In another embodiment, a waterslide may include a slide having a surface for supporting a flow of water thereon and at least one sensor coupled with the slide for interacting with tags affixed to users when the tags are positioned within a pre-determined distance to the sensor. Alternatively, the tags may be incorporated in or attached to water ride vehicles being controlled or manipulated by a user.

The water ride vehicle is preferably configured to support at least a portion of at least one rider, and travel on the surface of the slide with the flow of water. The illuminated water ride attraction may include one or more light strips for illumination that may be dynamically modified based on riders action or inaction, or input from a third person or device. For example, suitable feedbacks may be generated by the sensor and/or the water ride vehicle when a tag successfully or unsuccessfully interacts with or is sensed by the sensor. In another embodiment, user performance may be established based on the generated feedbacks. These or other feedbacks may also result in various modifications or enhancements of the ride experience, including ride vehicle modifications, illumination color or theme changes, music or sound effects, and/or other visual, tactile or audible sensory effects. Optionally, rewards, such as bonus score points or rides, may be provided to users based on user performance.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or combination of advantages as taught herein without necessarily achieving other objects or advantages as may be taught or suggested herein.

BRIEF DESCRIPTION OF THE DRAWINGS

FIG. 3A-2 shows a cross-sectional view of a flume clam-shell with integrated light strips in according to an embodiment of the present invention;

FIG. 5-1 illustrates a cross-sectional view of a waterslide tube with integrated light strips according to an embodiment of the present invention;

FIG. 5-2 illustrates a cross-sectional view of a waterslide tube with integrated light strips according to an embodiment of the present invention;

FIG. 10-1 illustrates a perspective view of a water ride vehicle according to an embodiment of the present invention;

FIG. 10-2 illustrates a top view of the water ride vehicle of FIG. 10-1 according to an embodiment of the present invention;

FIG. 10-3 illustrates a perspective view of the water ride vehicle of FIG. 10-1 carrying a rider according to an embodiment of the present invention; and FIG. 10-4 illustrates a perspective view of a handle of the water ride vehicle of FIG. 10-1 being held by a hand of a rider according to an embodiment of the present invention;

DETAILED DESCRIPTION

Figure 1A:
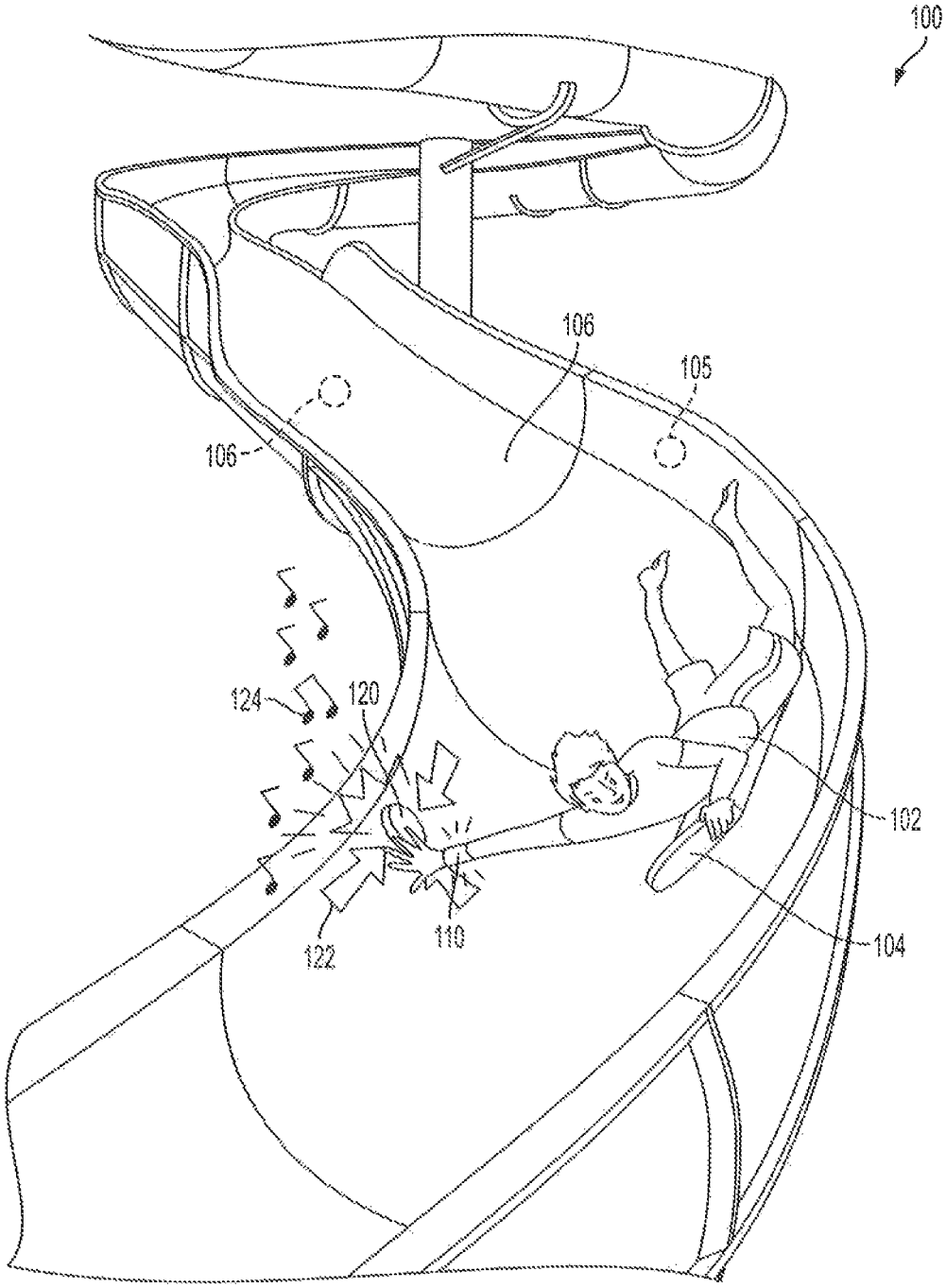
FIG. 1A shows a perspective view of a flume portion of a waterslide attraction capable of incorporating skill or agility of a user riding thereon with a slideboard according to an embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from the invention. Thus, embodiments of the invention are not intended to be limited to embodiments shown, but are to be accorded the widest scope consistent with the principles and features disclosed herein. The following detailed description is to be read with reference to the figures, which are not necessarily to scale, and which depict selected embodiments that are intended to teach and illustrate and not limit the scope of the invention. For convenience of description and for better clarity and understanding of the invention, similar elements in different figures may be identified with similar or even identical reference numerals. However, not all such elements in all embodiments are necessarily identical as there may be differences that become clear to persons skilled in the art when read and understood in the context of each particular disclosed preferred embodiment. Skilled artisans will also recognize the examples provided herein have many useful alternatives that fall within the scope of the invention.

FIG. 1A shows a perspective view of a slide or flume portion of a waterslide attraction configured to challenge or incorporate the skill or agility of a user riding thereon with a slideboard according to an embodiment of the present invention. In some embodiments, a slide portion 100 can be configured to allow a rider to manipulate a portion of the user 102 (e.g., hands, feet, etc.) and/or a ride vehicle 104 that the rider is riding thereon in order to interact with a component 120 that is disposed along the slide portion 100. For example, the user 102 may be connected with (e.g., wearing) a sensor 110 (e.g., a magnetic band or other material, RFID chip or tag, etc.) that is sensed when within a certain proximity of the component 120. This interaction with the component 120 may be in response to and/or cause audible 124 and/or visual 122 indications, as discussed in greater detail below.

In some embodiments, for example, as shown in FIG. 1A, the user 102 can ride the slide portion 100 in a front-facing and stomach-down position via a ride vehicle 104 that is configured to support the user 102 thereon and ride upon a flow of water flowing along a sliding surface 106 of the slide portion 100. Alternative ride positions can be used in alternative embodiments and are discussed in more detail herein. For example, multi-person luges, with or without ride vehicles strapped to the persons, can be utilized. In addition to manipulation of the ride vehicle 104, the user 102 may also have one or more of the sensors 110 and/or tags affixed thereto (e.g., via clothing, straps, bands, or other accessories worn or coupled to the user 102) that can be used for demonstrating skill or agility while riding the slide portion 100. In some embodiments, one or more sensors 110 and/or tags can be embedded or fastened with or within a controller (e.g., a videogame gamepad) having buttons or other interactive elements that the user 102 can manipulate with their fingers and/or hands as they slide down the slide portion 100. In some embodiments, the controller can be attached to the ride vehicle 104 in a convenient location for manipulation by the user 102 (e.g., on or adjacent to handles of the ride vehicle 104 or other ride vehicle). In certain embodiments, sensors 110 and/or tags can be coupled directly onto the handles or other portion of the ride vehicle.

The sensors 110 and/or tags may include a location mechanism that provides locations of riders wearing the sensors 110 and/or tags as they navigate along the slide portion 100. For example, the location mechanism may be or may incorporate a reed switch sensor included in the sensor 110 and/or tag, which is activated when it moves over magnetic sync points (105, 106) embedded at various locations along the slide portion 100. The location mechanism may wirelessly send the locations of riders to a system located remote from the slide portion 100. The system may display the rider's location for viewing by others, or use this information for other purposes, for example, calculating the traveling speed based on the travel time and distance between two magnetic sync points. For example, a timer may be initiated at a start of a ride when the user 102 begins to traverse down the slide portion 100. Upon reaching a magnetic sync point (105, 106), the user 102 is sensed via the sensor 110 and/or tag. This information regarding sensing of the user is transmitted to the system. The system is then able to determine a number of characteristics or parameters for the rider based upon the triggering of the user 102 being at a given magnetic sync point (105, 106) and the time elapsed from initiation of the timer to arrive at such location. For example, the rider's velocity may be determined. This velocity or other characteristic or parameter of the rider may be used to sound or display various indications along the slide portion 100 (such as visual theming or sound effects) since the location of the rider along the slide portion 100 can either be directly sensed via a given magnetic sync point (105, 106) or predicted based upon the system's knowledge of the slide path and the velocity or other characteristic or parameter of the user 102. Other types of location mechanism may include infrared transmission, wireless radio frequency communication, photo sensors, sonar sensors, radio frequency identification ("RFID"), proximity sensors, near-field chip ("NFC"), hall-effect sensors, and accelerometer. See, for example, US20020080198 to Giraldin, the entire contents of which is incorporated herein by reference.

Some embodiments of the invention may include a slide portion 100 that may have one or more components 120 (such as a sensor) coupled thereto that can be configured to interact with the sensor 110 and/or tag worn by the user 102 when the sensor 110 and/or tag comes within a pre-determined distance to a given component 120. In some embodiments, this pre-determined distance to the sensor for triggering can be adjusted based upon age, talent of the user, etc. In this manner, in some embodiments, various components 120 can be positioned at various locations along the slide portion 100 for requiring various user behaviors. For example, the user 102 may either position a limb containing a tag 110 near or adjacent to a respective component 120, or otherwise manipulate the position of the ride vehicle 104 within the slide portion 100 in order for the respective component 120 to detect the sensor 110 and/or tag. In some embodiments, the user 102 may otherwise interact with the respective component 120 when the sensor 110 and/or tag and/or a controller, such as a gamepad, is near or adjacent thereto, for example, by pressing a button upon an associated controller or gamepad or upon a portion of a ride vehicle, as previously discussed. Once detection occurs, any of a variety of features or aspects of the waterslide attraction can be modified, as discussed in greater detail herein.

In some embodiments, in order to identify to the user 102 how to interact with the slide portion 100, various cues can be displayed or otherwise made available to the user 102. For example, visual indications 122 can be disposed along the slide portion 100 for indicating the presence of a component 120 or other receiver that the user 102 may desire to interact with. In one embodiment, the visual indication 122 may be green arrows for telling the user 102 to move the sensor 110 and/or tag adjacent to the component 120. In another embodiment, different colored or shaped visual indications may represent different manners in which the user 102 should interact with the component 120, such as moving the sensor 110 and/or tag within a pre-determined distance or pressing a button when within a predetermined distance, as discussed in greater detail below. In still another embodiment, the visual indication 122 may be a red "X" for telling the user 102 to keep the sensor 110 and/or tag away from the component 120 or that the user 102 is positioned on a wrong side of the slide portion 100. Audible indications 124 may also be associated with the component 120. For example, specific tones or noises can be played near the component 120 for similarly advising a user 102 how to interact with the component 120, similar to the discussion above for the visual indications 122. Thus, audio and/or visual elements may be used for positive and/or negative indications. The indications may also provide feedback ranging between purely negative and positive feedback. Tactile feedback could also be provided, such as a vibration of the ride surface and/or a user-interfacing surface of the ride vehicle.

The component 120 may be embedded, flush mounted, or attached to the sliding surface 106. For identification, the component 120 may also include static light emitting diodes ("LED"), sticker/decals, color paint (including glowing paint or UV reactive paint), and/or addressable LEDs that allow a wide array of dynamic options regarding color, graphics, and animations.

Figure 1B:
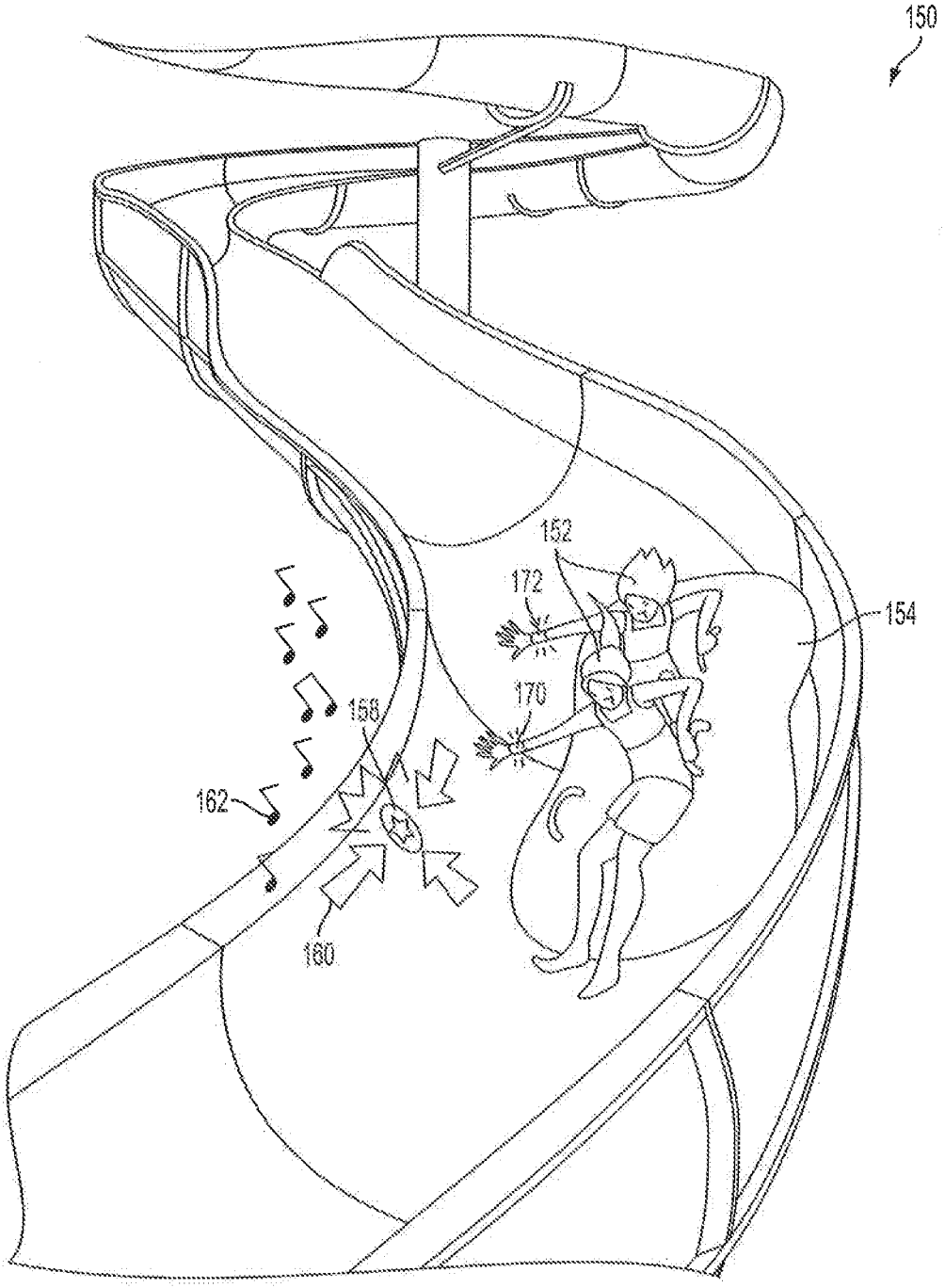
FIG. 1B shows a perspective view of a flume portion of a waterslide attraction capable of incorporating skill or agility of a plurality of users riding thereon with an inflatable tube according to an embodiment of the present invention.

FIG. 1B shows a perspective view of a slide or flume portion 150 of a waterslide attraction, similar to the discussion above for FIG. 1A, but demonstrates a plurality of riders 152 utilizing a ride vehicle (e.g., an inflated tubing device) 154 for riding thereon. Similar to the discussion above, visual indications 160 and/or audible indications 162 act in conjunction with one or more components 158 (e.g., sensors) disposed along the slide portion 150 for sensing one or both sensors and/or tags (170, 172) of the plurality of riders 152. In one embodiment, identification information can be different for each sensor and/or tag (170, 172), for example, to permit riders traveling together down the waterslide attraction to compete for obtaining different high scores. In an alternative embodiment, identification information can be the same for the sensors and/or tags (170, 172), for example, to permit riders traveling together down the waterslide attraction to cooperate for obtaining a single high score.

Some embodiments of the waterslide attraction comprise one or more features designed to attract new riders and retain riders for further multiple riding attempts. For example, some embodiments include a loyalty function that may award and/or unlock features after a certain number of rides or a certain ride time. Similar to the discussion above, visual indications (122, 160) and/or audible indications (124, 162) can act in conjunction with one or more components (120, 158). Different sensors and/or tags (170, 172) may be used to identify riders and allow a conventional control system to tally and/or track each rider's use of one or more waterslide attractions. In some embodiments, the rider may actuate the component (120, 158), either by moving the sensor and/or tag (170, 172) within a pre-determined distance to the component (120, 158) or by pressing a button when the sensor and/or tag (170, 172) is within a pre-determined distance to the component (120, 158). In some embodiments, the ride use can be correlated with at least one award to a rider. For example, in some embodiments, after a certain number of rides, the rider may be awarded with one or more bonus rides and/or an extended ride time. In other embodiments, as the ridership of any rider increases, awards and other bonus features awarded to the rider can be increased. Persons skilled in the art will readily appreciate that any or all of these functional features may be readily carried out through one or more software programs associated with the ride control system and/or an external computer tracking system associated with the water ride.

Figures 1, 3A:
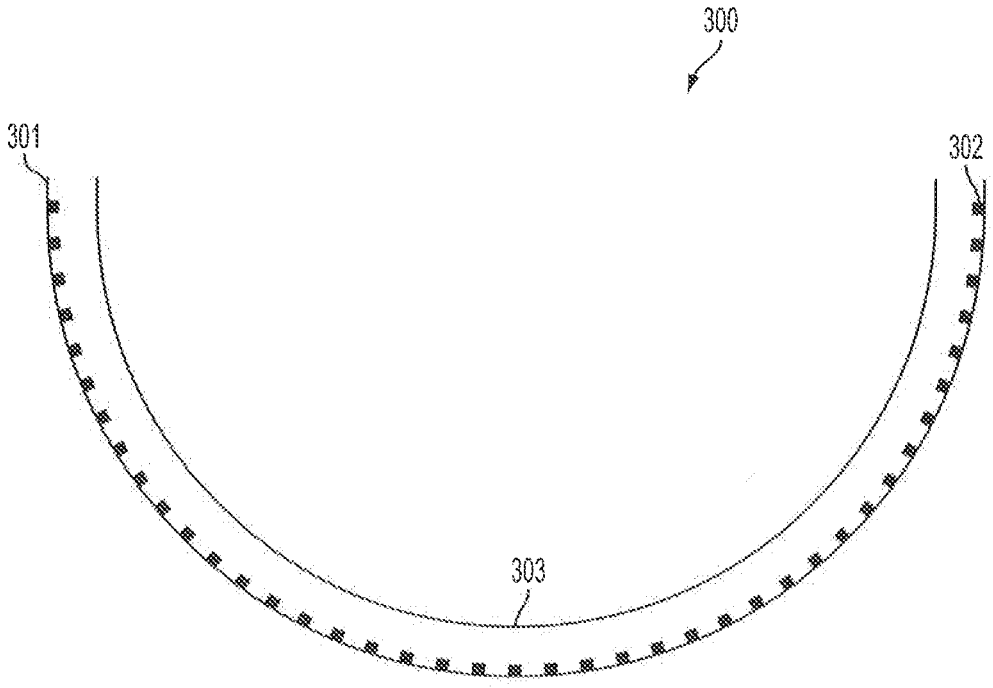
FIG. 3A-1 shows a cross-sectional view of a flume clam-shell with integrated light strips according to an embodiment of the present invention.
Figures 2, 3A:
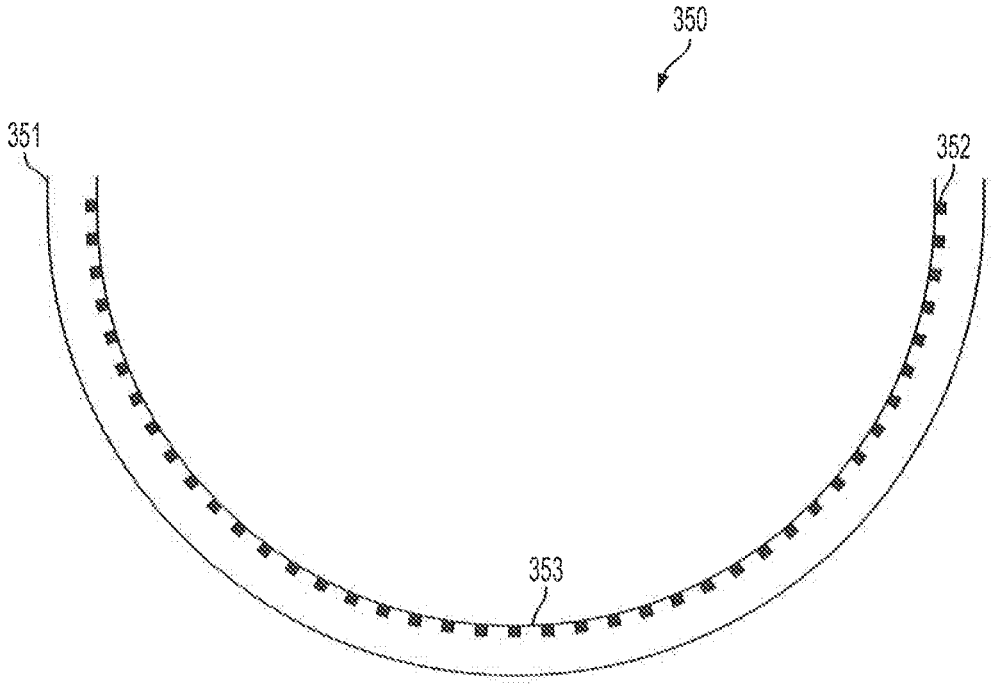
Figures 1, 10:
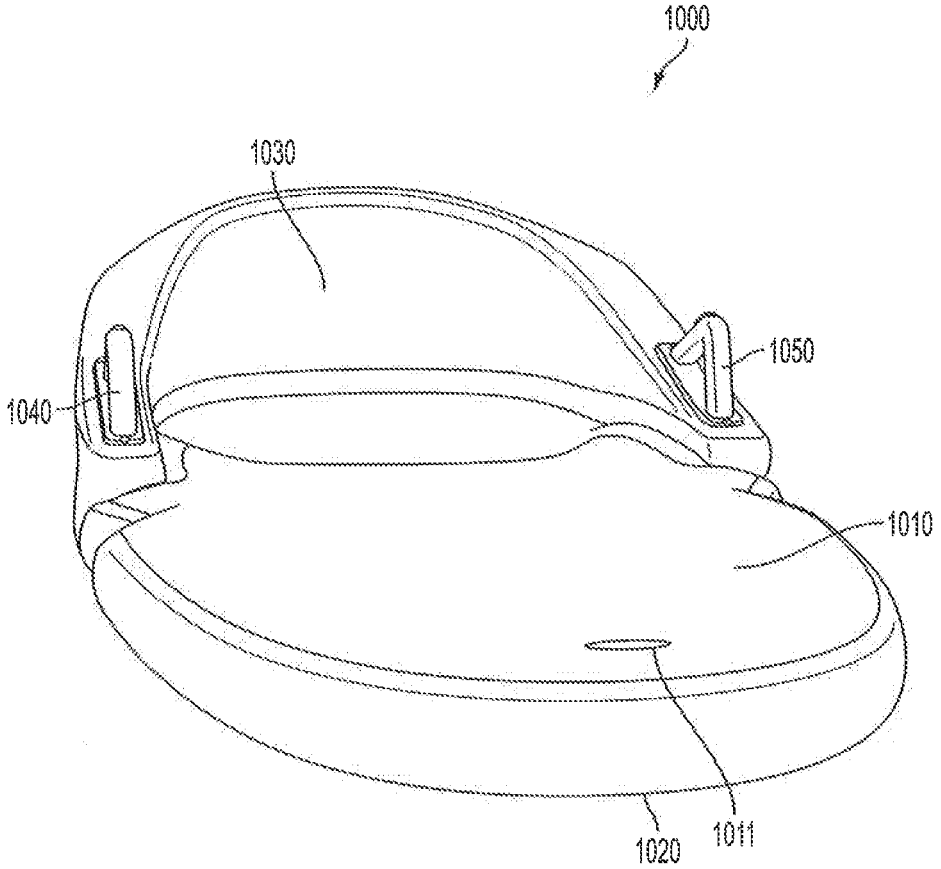
Figures 2, 10:
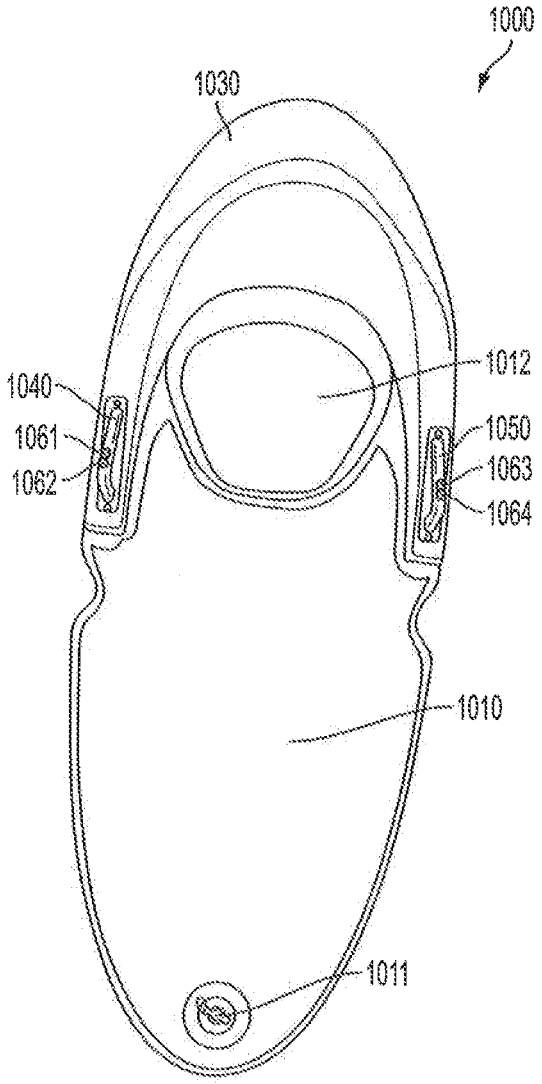

Any of a variety of water ride vehicles may be utilized in alternative embodiments. For example, although a ride vehicle 104 or an inflatable tube 154 with particular features or characteristics are shown in FIGS. 1A and 1B, respectively, other water ride vehicles including mats or riding surfaces in addition thereto or alternatively therefrom may be utilized. FIGS. 10-1 and 10-2 illustrate yet another embodiment of possible water ride vehicles. Sensors and/or tags can be included within or on a water ride vehicle in addition to or in replacement of the tags worn by riders. No tags may be necessary in certain embodiments, such as those rides which utilize gamepads or controllers, similar to those described above.

Figure 4:
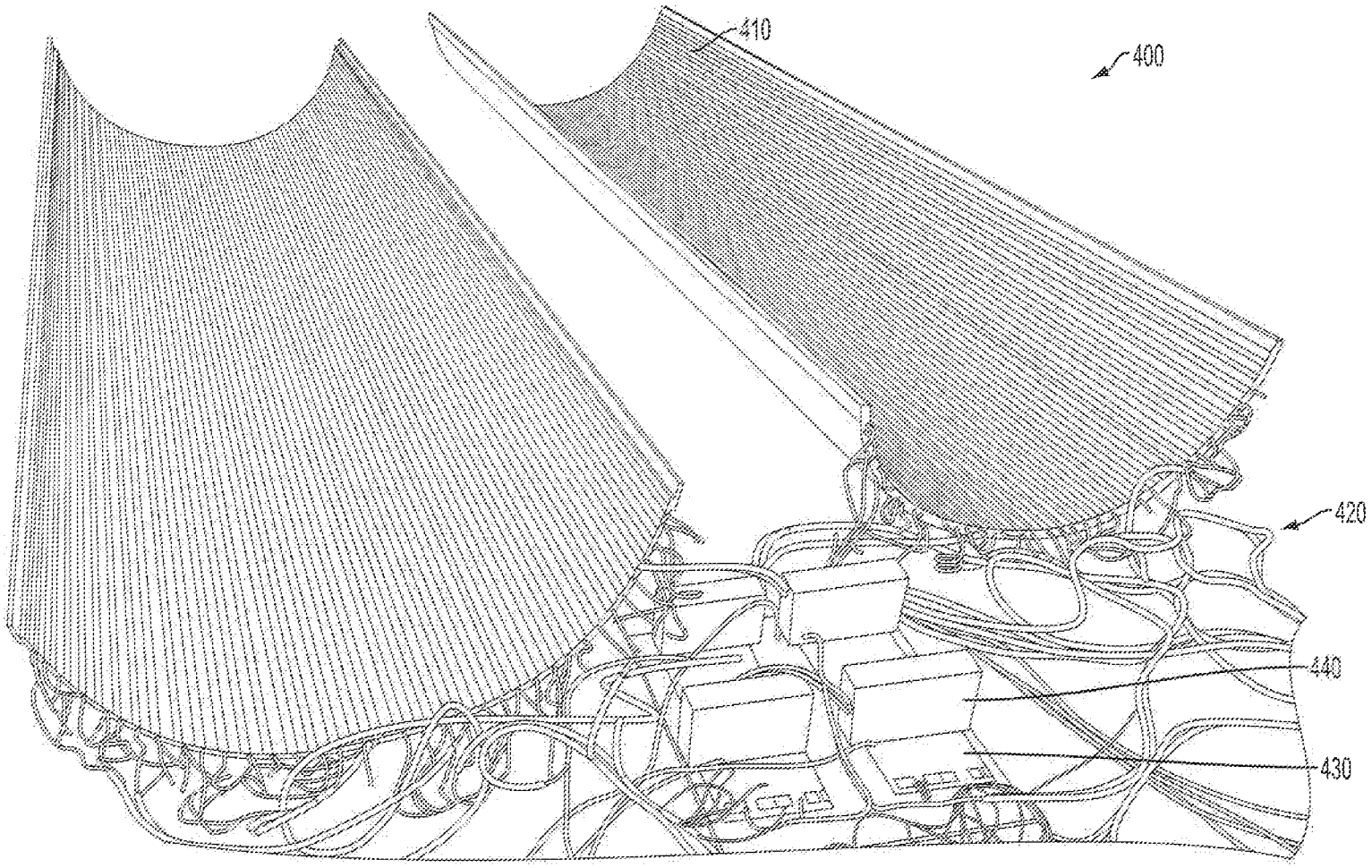
FIG. 4 illustrates perspective views of two flume clam-shell halve sections with integrated LED light strips according to an embodiment of the present invention.

Turning next to an embodiment of a ride vehicle that may be used, FIGS. 10-1 through 10-4 showcase a ride vehicle 1000 (e.g., a slideboard) that may be used on slides or amusement attractions, for example, like those discussed above. The ride vehicle 1000 includes a top surface 1010 and a bottom surface 1020, the bottom surface configured to contact a flow of water 1001 and/or a surface of an amusement attraction (e.g., a waterslide flume) during operation. A back structure 1030 provides support for a user to recline or make contact with a back of the user's body, such as for comfort and/or safety purposes, when the user is seated in the seating area 1012 of the ride vehicle 1000. As shown, the seating area 1012 may be closed, rather than an open hole, to the flow of water 1001 and/or surface of an amusement attraction during operation (e.g., a user's buttocks may not make direct contact with the water of the waterslide flume) when the user is seated in the seating area 1012 of the ride vehicle 1000. Two handles (1040, 1050) are connected with the back structure 1030 for the user to grasp during operation and/or for easier carrying of the ride vehicle 1000. An inflation element or opening 1011 may be provided to allow the ride vehicle 1000 to be regularly inflated to a desired air pressure. In an alternative embodiment, other dimensions, geometry, orientations, and/or features may be provided for a ride vehicle (e.g., greater or fewer handles may be provided and/or such handles may be connected directly with the top surface 1010).

Figures 3, 10:
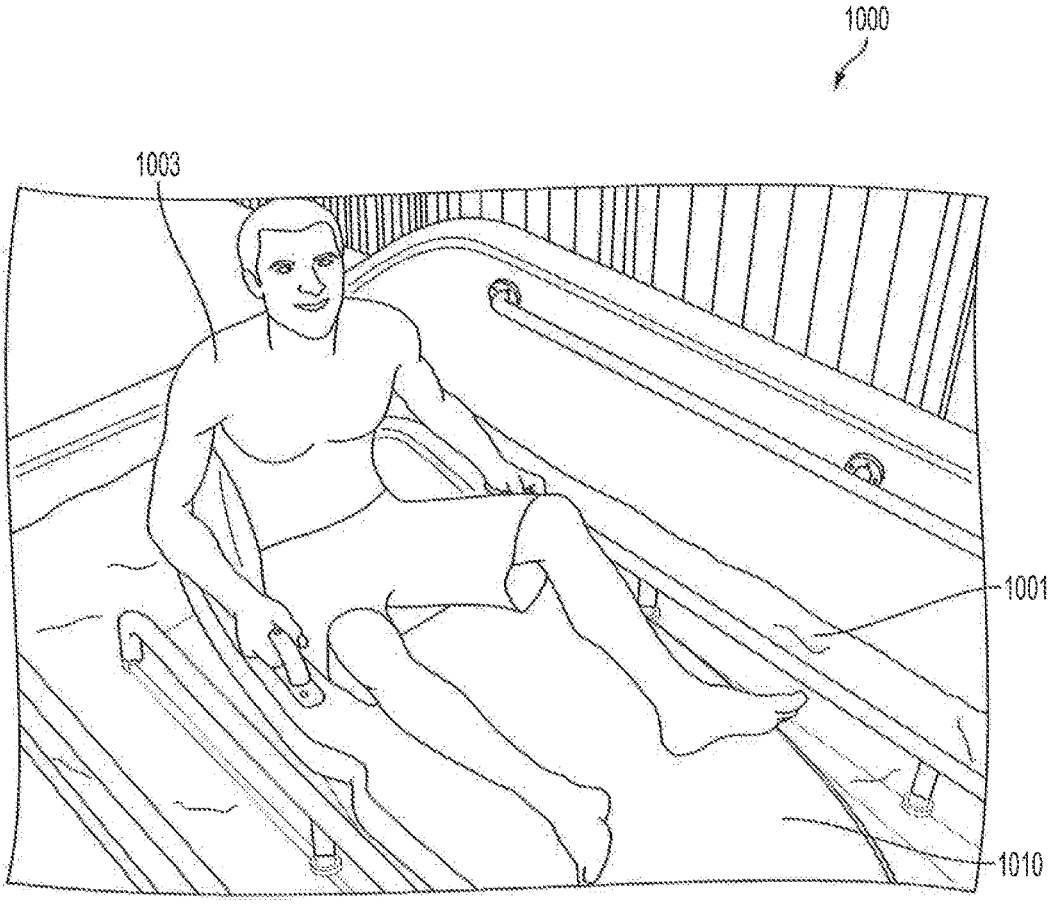
Figures 4, 10:
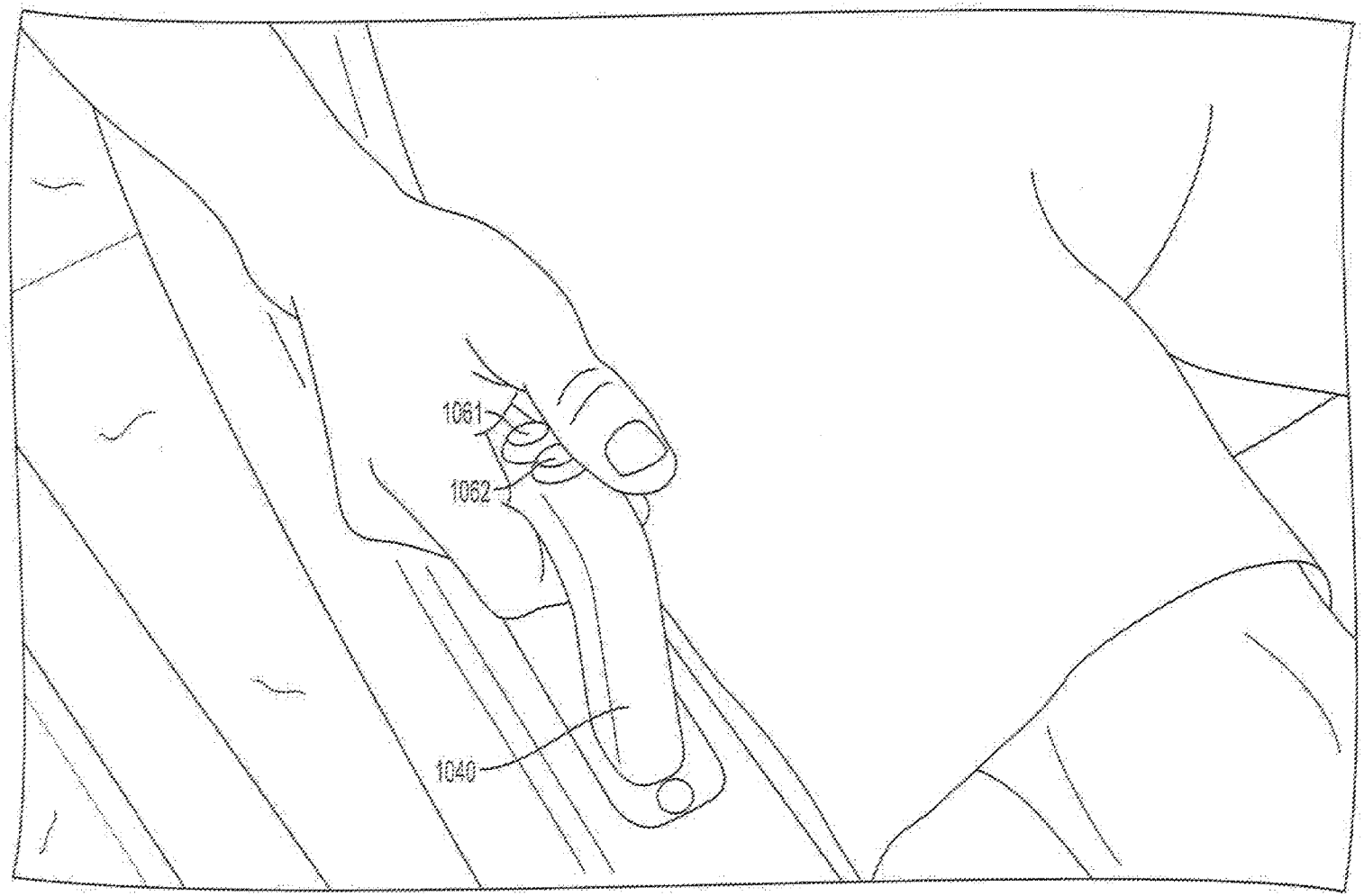

With attention on FIGS. 10-2 and 10-3, the ride vehicle 1000 preferably includes a first button 1061 (e.g., blue in color), a second button 1062 (e.g., green in color), a third button 1063 (e.g., yellow in color), and a fourth button 1064 (e.g., red in color) on the handles (1040, 1050) coupled to the ride vehicle 1000, that are configured to interact with a component (e.g., the component and/or sensor 120 of FIG. 1). The handles (1040, 1050) may function as controllers/gamepads, as discussed above. For example, as a user 1003 slides down a waterslide on the ride vehicle 1000, if a visual indication lights up a color corresponding to the first button 1061 (e.g., blue) when the user is within a vicinity of a component, sensor, and/or receiver capable to detecting such a button press, the user may timely press the corresponding first button 1061 that is coupled with the ride vehicle 1000 in order to activate certain sensory effects (e.g., color illumination), actions, or features of the waterslide (e.g., accumulation of points for the user, display of visual or audible activity, etc.).

In some further embodiments, other visual indication lights may be illuminated and the user can press a corresponding button (e.g., second, third, and/or fourth (1062, 1063, 1064)) that is coupled with the ride vehicle 1000. In some other embodiments, multiple visual indication lights may light up. In this instance, a rider can simultaneously and/or sequentially press multiple color buttons corresponding to the multiple visual indication lights. In some embodiments, multiple visual indication lights may light up in sequence, and a rider may press corresponding buttons in a sequential order corresponding to the sequential lighting order of the visual indication lights. In some embodiments, the visual indication lights and/or their lighting behavior may be different in different portions of the waterslide or may be based on a user's skill. For example, in some embodiments, the ease with which a rider may follow and act-upon the visual indication lighting may increase in difficulty based on their location in the slide or the rider's skill (based on the skill measured during the current ride, or progressively measured from an accumulated skill level developed over previous rides). Similar to the sensors and/or tags 110 described above, the water ride vehicle 1000 may include a location mechanism that provides locations of the ride vehicle 1000 as it navigates along the waterslide.

In addition to the color illumination change described above, in some embodiments, a water ride vehicle 1000 may include a feedback mechanism that provides the rider with responses via tactile, audible, and/or visual feedback upon successfully or unsuccessfully interacting with the sensor. The feedback mechanism may be used in conjunction with gamepads or controllers (e.g., the handles (1040, 1050) with a plurality of buttons (1061, 1062, 1063, 1064) described above) in order to provide the user with an understanding of the user's performance. In some embodiments, the ride vehicle 1000 includes the feedback mechanism that collects data relating to feedbacks generated from the rider's successful and unsuccessful interactions with all sensors throughout the ride, and transfers the data, via wireless protocols (e.g., radio frequency protocols, mesh network, smart mesh, or Wi-Fi standards including 802.11), to a database system (e.g., a computer or computer network) that in turns displays the data for viewing. In some embodiments, the feedback mechanism transfers the collected data in real time.

In some embodiments, the plurality of buttons (1061, 1062, 1063, 1064) are capable of being submerged under water. Such buttons may include, for example and without limitation, membrane switches, piezo switches, pressure switches, rotary switches, joysticks, and toggle switches.

Figure 2A:
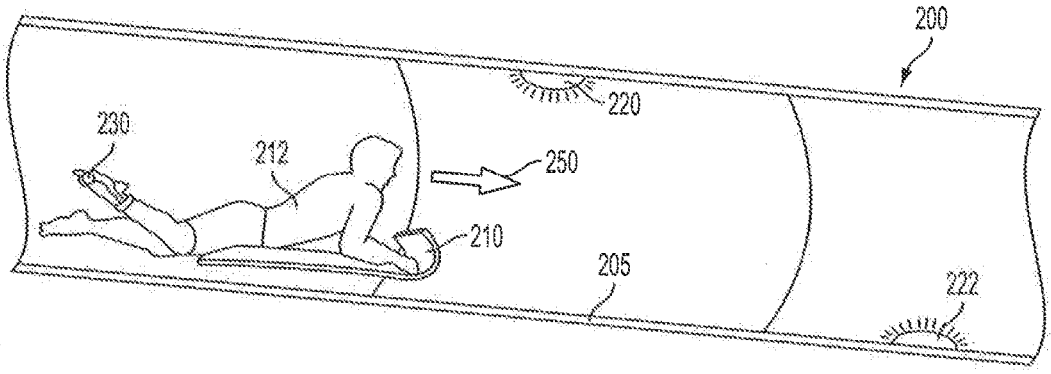
FIG. 2A shows a side view of a slide portion of a waterslide attraction capable of incorporating skill or agility of a rider thereon at a first position with a sensor attached to an foot of the rider according to an embodiment of the present invention.
Figure 2B:
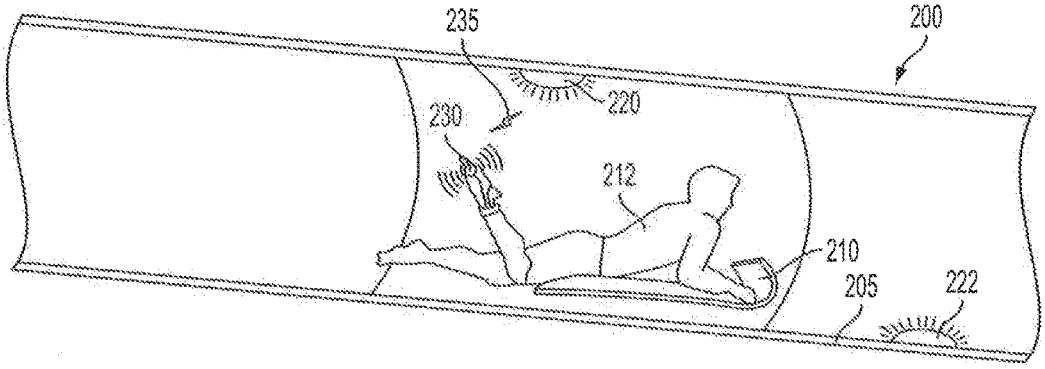
FIG. 2B shows a side view of the slide portion of the waterslide attraction of FIG. 2A with the rider at a second position with the sensor attached to the foot of the rider according to an embodiment of the present invention.
Figure 2C:
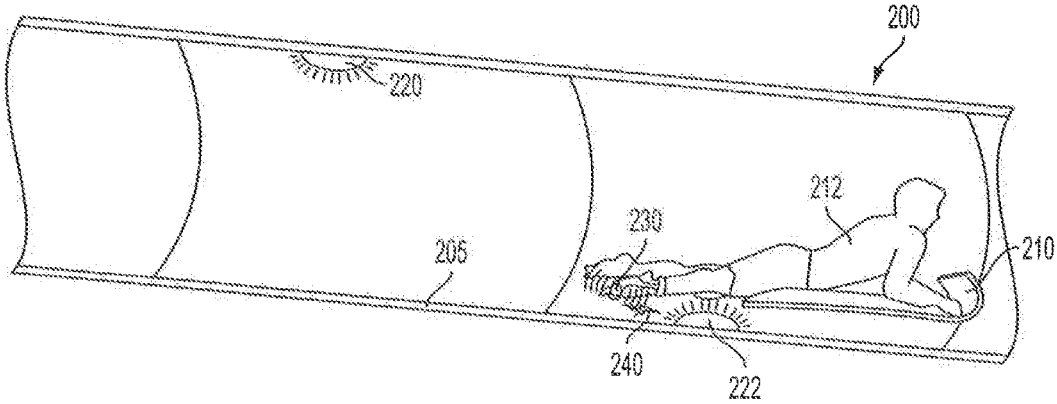
FIG. 2C shows a side view of the slide portion of the waterslide attraction of FIG. 2A with the rider at a third position with the sensor attached to the foot of the rider according to an embodiment of the present invention.

Turning back to FIGS. 2A-2C, a waterslide attraction 200 is shown having a sliding surface 205 upon which a rider 212 upon a mat 210 or other riding board or vehicle may slide down along a main travel path 250 from an entrance location to an exit location. The waterslide attraction 200 may contain features that are the same as or similar to those previously discussed. In certain embodiments, no mat 210 or other riding board or vehicle may be used. The same or similar as previously discussed, the waterslide attraction 200 incorporates sensors (220, 222) at various locations along the waterslide attraction 200. The sensors (220, 222) are configured to sense or otherwise detect a tag 230 or other element that is worn around or near a foot or ankle of the rider 212 when the tag 230 is within a pre-determined proximity of a particular sensor (220, 222). The sensors (220, 222) may be embedded, flush mounted, or attached to the sliding surface 205.

The sensors (220, 222) may also include indicator elements or components (e.g., light-emitting devices and/or sound emitting devices) such that as the rider 212 successfully activates the sensors (220, 222) or fails to activate the sensors (220, 222) when in their proximity, the sensors (220, 222) provide the rider 212 with an indication of such success or failure. As demonstrated in FIG. 2A, the rider 212 is initially in a first position where no sensors (220, 222) are within a proximity to be activated and thus the position of the foot of the rider 212 is of no consequence. However, as demonstrated in FIG. 2B, as the rider 212 travels along the main travel path 250 and gets closer to the first sensor 220 located above the rider 212 in the waterslide attraction 200, the rider 212 must skillfully raise their foot with the tag 230 such that the first sensor 220 appropriately senses 235 the tag 230 (e.g., via radio communication). Further, as demonstrated in FIG. 2C, as the rider 212 continues to travel along the main travel path 250 and gets closer to the second sensor 222, located below the rider 212 in the waterslide attraction 200, the rider 212 must skillfully lower their foot with the tag 230 such that the second sensor 222 appropriately senses 240 (e.g., via radio communication) the tag 230.

Because the rider 212 may be using their hands or arms to help steer the mat 210 along the sliding surface 205, tags 230 placed on one or more of the users feet, ankles, or legs may provide an added level of difficulty or challenge for the rider 212 in attempting to obtain a high score while riding the waterslide attraction 200. Thus, individuals who are not as skilled or do not wish to attempt a more difficult run may be permitted to utilize the waterslide attraction 200 without any tags 230 located on their feet, ankles, or legs. For example, the first sensor 220 can be disabled for such attempts on the waterslide attraction 200 since the only tag(s) to be read on the given attempt may, for example, be located in the mat 210 itself. Alternative embodiments may see the tag 230 placed in additional or alternative locations on the rider 212. As previously mentioned, in an alternative embodiment, rather than moving a tag worn by a rider within a vicinity of a sensor for successful activation, a tag can be included as part of a gamepad or as part of a water ride vehicle and a user can be required to successfully press a corresponding button or element when within a vicinity of the sensor, in response to a visual or audible cue (e.g., pressing a blue button in response to a blue light). Optionally, as described above, the gamepad may also provide visual, aural, or tactile feedbacks to the user as the user interacts with the sensor. Pressing the button or element causes a signal to be received by a sensor or controller within a vicinity of the tag, to either modify a feature of the attraction, the same as or similar to previous discussions, and/or to accumulate points to determine a score for the rider, the same as or similar to previous discussions.

In some embodiments, the waterslide attraction capable of incorporating skill or agility of a user riding thereon as described above may include at least one visual or audible indication (such as the visual indicators 122, 160, and 222 discussed earlier or other visual cues or displays). In some embodiments, the waterslide may comprise a flume and/or a plurality of coupled flume segments including at least one visual indication. In some other embodiments, the waterslide may comprise a pipe or chute and/or a plurality of coupled chute or pipe segments including at least one visual indication. In some embodiments, the water slide may comprise both flume and chute portions, each comprising one or more segments, in which at least one of the flume or chute segments or portions includes at least one visual indication.

In some embodiments, the waterslide may comprise segments that are substantially straight. In other embodiments, the waterslide may comprise a segment or plurality of segments that form at least a portion of the waterslide that is at least partially angled, curved, bent, twisted, or a combination thereof. In some other embodiments, at least a portion of the waterslide can be deformable or moveable. For example, in some embodiments, at least a portion of the waterslide can be moved or deformed relative to another portion of the waterslide while the waterslide contains a rider, in which at least one of the portions includes at least one visual indication that moves with the waterslide segment. Some embodiments include at least a portion of the waterslide that can be moved or deformed relative to another portion of the waterslide while either one or both portions comprises a least one visual indication. Such movements and other effects may be controlled, for example, by a software program executed by the ride control system as part of an interactive ride experience that changes based on rider performance, experience or skill level.

In some embodiments, the waterslide may comprise at least one visual indicator including one or more light emitting components (e.g., LEDs). For example, FIG. 3A-1 shows a cross-sectional view of a flume clam-shell 300 with integrated light strips 302 in accordance with some embodiments of the invention. In some embodiments, the waterslide can comprise an inner member comprising an inner surface 303 (i.e., a ride surface) that can be at least partially submerged in water, and an outer member that includes an outer surface 301 and an inner surface. In some embodiments, the inner and outer members can be coupled to form an inner volume that is isolated from the inner surface 303 of the inner member, so that any water contained on and/or within the inner surface 303 of the inner member is prevented from entering the inner volume.

In some embodiments, at least some portion of the inner volume can form an illumination or display cavity. For example, as depicted in FIG. 3A-1, in some embodiments, one or more light strips 302 may be distributed within the cavity and attached to the inner surface of the outer member 301. Further, in some embodiments, at least a portion of the inner member may comprise a material that is at least partially transparent or translucent to visible light so that light emitted from one or more of the light strips 302 may pass through the inner member towards the inner portion of the waterslide so as to be viewable by one or more riders. In some embodiments, at least a portion of the inner member can comprise a material that is translucent to light so that light emitted from one or more light strips 302 may pass through the inner member towards the inner portion of the waterslide. In some embodiments, the waterslide may comprise an inner member that enables a user (e.g., a rider looking out from the inner portion) to view direct, substantially un-diffused illumination from one or more light strips 302 distributed within the cavity. In other embodiments, the waterslide may comprise an inner member that enables a user to view diffused illumination from one or more light strips 302 distributed within the cavity.

In some embodiments, at least a portion of the inner member can comprise a material that is translucent to ultraviolet light so that light including ultraviolet wavelengths emitted from one or more light strips 302 may pass through the inner member towards the inner portion of the waterslide. In some embodiments, the waterslide may comprise an inner member that enables a rider to view and to be illuminated by one or more light strips 302 distributed within the cavity. In some embodiments, the rider can be in possession of a tag or wearable article that is substantially phosphorescent and/or reflective in the present of ultraviolet light. In some embodiments, a rider, carrying a tag or wearable article that is substantially phosphorescent and/or reflective in the present of ultraviolet light may show enhanced illumination when passing one or more light strips that emit ultraviolet light. In other embodiments the tag or wearable article may comprise a UV-triggered color-changing material such as plastic beads and other items commercially available from SolarActive®.

In some embodiments, the light strips 302 can be positioned and/or secured against the inner surface of the outer member (as illustrated in the embodiment of FIG. 3A-1). One of ordinary skill in the art would recognize that the light strips may include other arrangements, and can be positioned anywhere within the cavity. For example, in some other embodiments (as illustrated in the embodiment of FIG. 3A-2), the light strips 352 can be positioned and/or secured against the outer surface 353 of the inner member rather than the inner surface 351 of the outer member. In some further embodiments (not shown), the light strips can be supported between the inner and outer members, embedded in the inner and/or outer members, or flush mounted to the inner surface of the inner member. Flush mounting allows for maintenance to occur from within the clam-shell. Some embodiments may include groups of light strips positioned in different locations within the cavity. For example, in some embodiments, one group of light strips can be positioned against the inner surface of the outer member, and a further group of light strips can be positioned against the outer surface of the inner member.

In some other embodiments, the clam-shell may be used to at least partially enclose a waterslide. For example, in some embodiments, the clam-shells (300, 350) shown in FIGS. 3A-1 and 3A-2 can be wrapped around a portion of a waterslide (e.g., either a flume or a chute portion). Such a configuration allows for waterslides to be refurbished with such lighting elements. Refurbishment of such waterslides may also incorporate the addition or sensors and/or tags or other components for gaming functions (e.g., user interaction, accumulation of points, etc.) as discussed elsewhere herein.

Figure 3B:
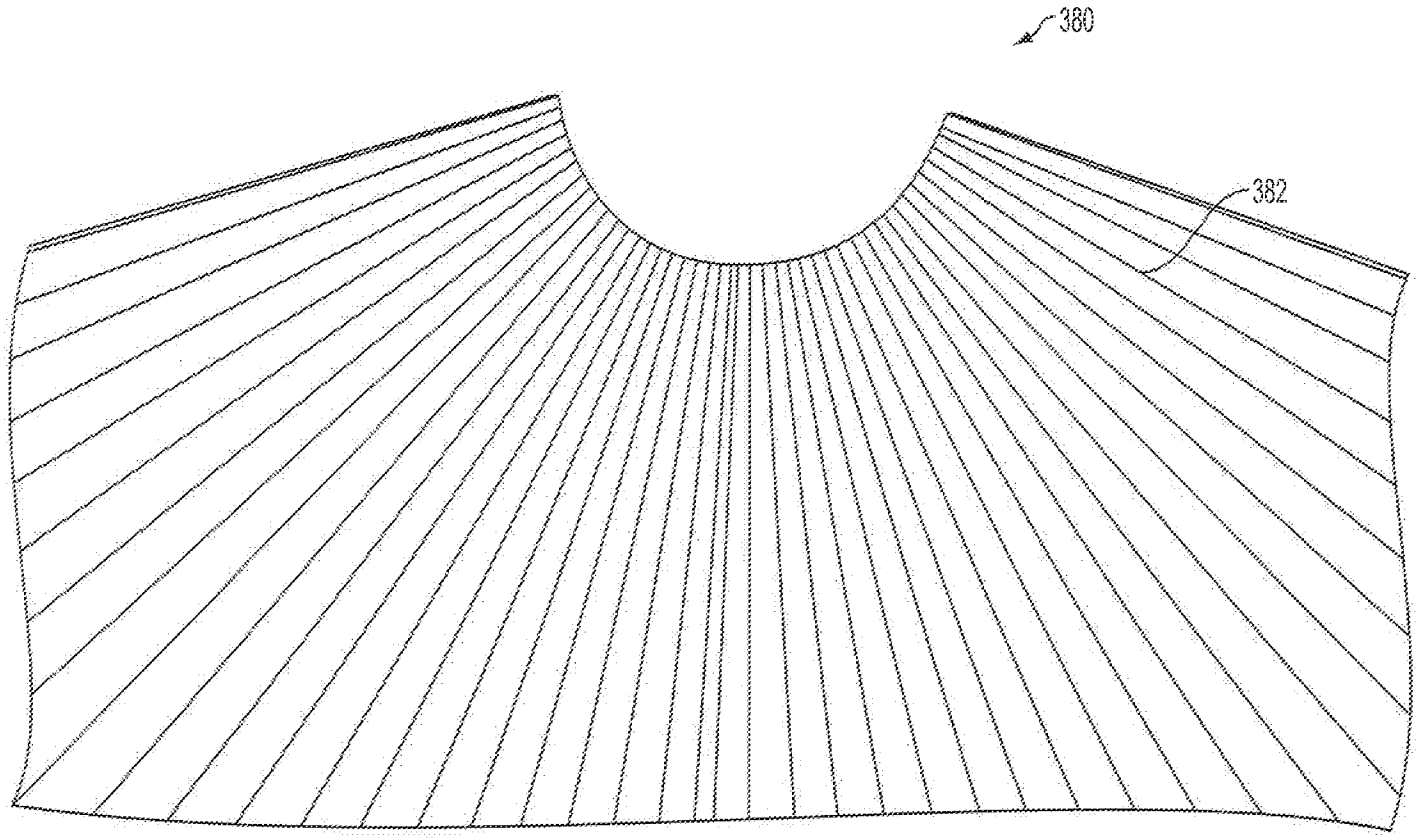
FIG. 3B illustrates an inner perspective view of a portion of a flume clam-shell with integrated LED light strips according to an embodiment of the present invention.

FIG. 3B illustrates an inner perspective view of one portion of a flume or chute clam-shell 380 with integrated LED light strips 382 in accordance with some embodiments of the invention. As shown, the light strips 382 can extend through the longitudinal dimension of the clam-shell, and may comprise a plurality of light strips circumferentially distributed around the clam-shell. In some embodiments, the clam-shell may comprise 38 circumferentially distributed light strips. In some other embodiments, the clam-shell may comprise more or less circumferentially distributed light strips, distributed or clustered with a lower or a higher density that than as specifically shown in FIG. 3B. In some embodiments and as shown, the light strips can be substantially equally spaced around the circumference of the clam-shell. In other embodiments, the light strips can be spaced substantially around the circumference of the clam-shell in clusters of various sizes.

FIG. 4 illustrates perspective views 400 of two flume clam-shell halve sections (401, 402) that have with integrated LED light strips 410 (e.g., LED). As shown, the light strips 410 may include one or more control and/or power conduits or cables 420 extending from at least one end of the two flume clam-shell halve sections. In some embodiments, at least one of the integrated power strips as shown can be coupled to a power supply 430 and/or at least one control board 440. In some embodiments, the power supply 430, control board 440 or both can be coupled to at least one computer (i.e., a single personal computer or computer server).

In some embodiments, the light strips 410 can be controlled wirelessly. For example, in some embodiments, the power supply 430, control board 440 or both can be coupled to at least one computer through a wireless connection. In some embodiments, at least one of the light strips 410 can be controlled using at least one software module processed and sent by the computer or computer server.

One or more of the light strips 410 can be embedded within an inner member, an outer member, or both of a waterslide (e.g., made up of clam-shell halve sections). For example, as shown, one or more of the light strips 410 can be embedded within the inner member of a waterslide during fabrication of the inner member including electrical connections that exit inner member at an edge or an outer surface of the inner member.

In some embodiments, the light strip 410 may comprise one or more light emitting devices, including, but not limited to a light emitting diode ("LED"). In this instance, the light strip 410 may comprise a plurality of LED devices, each of which can be individually addressable. The use of LED's as an illumination source can provide high levels of brightness and intensity with little or no ultraviolet emission, and with low-voltage and current requirements. The LED's may advantageously function with high-efficiency, low radiated heat, long life, and high reliability (including resistance to shock and vibration that is common in many waterslide environments).

In some embodiments, the plurality of LED devices may comprise at least one of a red light emitting LED, a blue light emitting LED and a green light emitting LED. In some embodiments, other colors can be included, including, but not limited to white, yellow, orange, or magenta light emitting LED's. In addition or in replacement to a light strip 410 using LED strips, some embodiments may comprise LED tiles and/or LED display segments. In some embodiments, at least some portion of the LED strips can also include a curved display (i.e., some portion of the LED strip is curved, bent or angled).

Some embodiments may comprise other light emitting devices, including for example solid-state light-emitting devices based on organic semiconductors such as organic-light-emitting-devices ("OLEDS"). OLED's can be made thin and/or flexible, and can be used to form flat or curved display. For example, in some embodiments, the waterslide may include an attached or integrated OLED display, or an OLED display that is wrapped around at least a portion of the waterslide. These may display a computer-animated sequence of images in accordance with a desired ride experience theme and/or as a reward or encouragement for repeat riders. In some embodiments, at least a portion of any one segment of the waterslide may include an OLED display portion. In some embodiments, the OLED display may at least partially encircle the waterslide, and in some embodiments, may provide a 360° display to a rider. In some embodiments, the waterslide may include a passive-matrix OLED ("PMOLED"), an active-matrix ("AMOLED") OLED, or a combination thereof. Some other embodiments may include phosphorescent OLED technology.

In some further alternative embodiments, the visual indication can be shone into the waterslide from outside of the waterslide. For example, light can be directed into the waterslide at least through the inner member so as to be viewed by a rider. In some embodiments, visual indication can be shone into the waterslide from outside of the waterslide using integrated LED light strips. In some embodiments, visual indication can be shone into the waterslide from outside of the waterslide using an LED display. In some other embodiments, the visual indication can be shone into the waterslide from outside of the waterslide using a conventional lamp system, such as an incandescent lamp system, using an LED lamp system, or using a projector lamp system. In some other embodiments, the visual indication can be shone into the waterslide from outside of the waterslide using a conventional laser system.

In some embodiments, the waterslide inner member may comprise or include the outer member. For example, there may be no inner cavity per se, and the visual indication can be shone into the waterslide from outside of the waterslide directly through the inner member.

Various types of waterslide or amusement ride geometries may be constructed that include visual illumination capabilities. For example, some embodiments can include a waterslide or amusement ride that comprises a chute or tube that includes at least one visual indicator including one or more light emitting components. As discussed earlier, the waterslide can comprise a flume comprising a clam-shell as shown in FIGS. 3A-1 and 3A-2 that includes an inner member comprising an inner surface (i.e., a ride surface) that can be at least partially submerged in water, and an outer member that includes an outer surface and an inner surface. In some further embodiments, by coupling two clam-shells, a waterslide chute or tube can be constructed. In some other embodiments, the clam-shell halves can be used to fully enclose a waterslide. For example, in some embodiments, two substantially identical clam-shells (for example, those shown in FIGS. 3A-1 and 3A-2) can be wrapped around a waterslide to form a substantially enclosed waterslide as depicted in FIGS. 5-1 and 5-2, as discussed in greater detail below.

Figure 6:
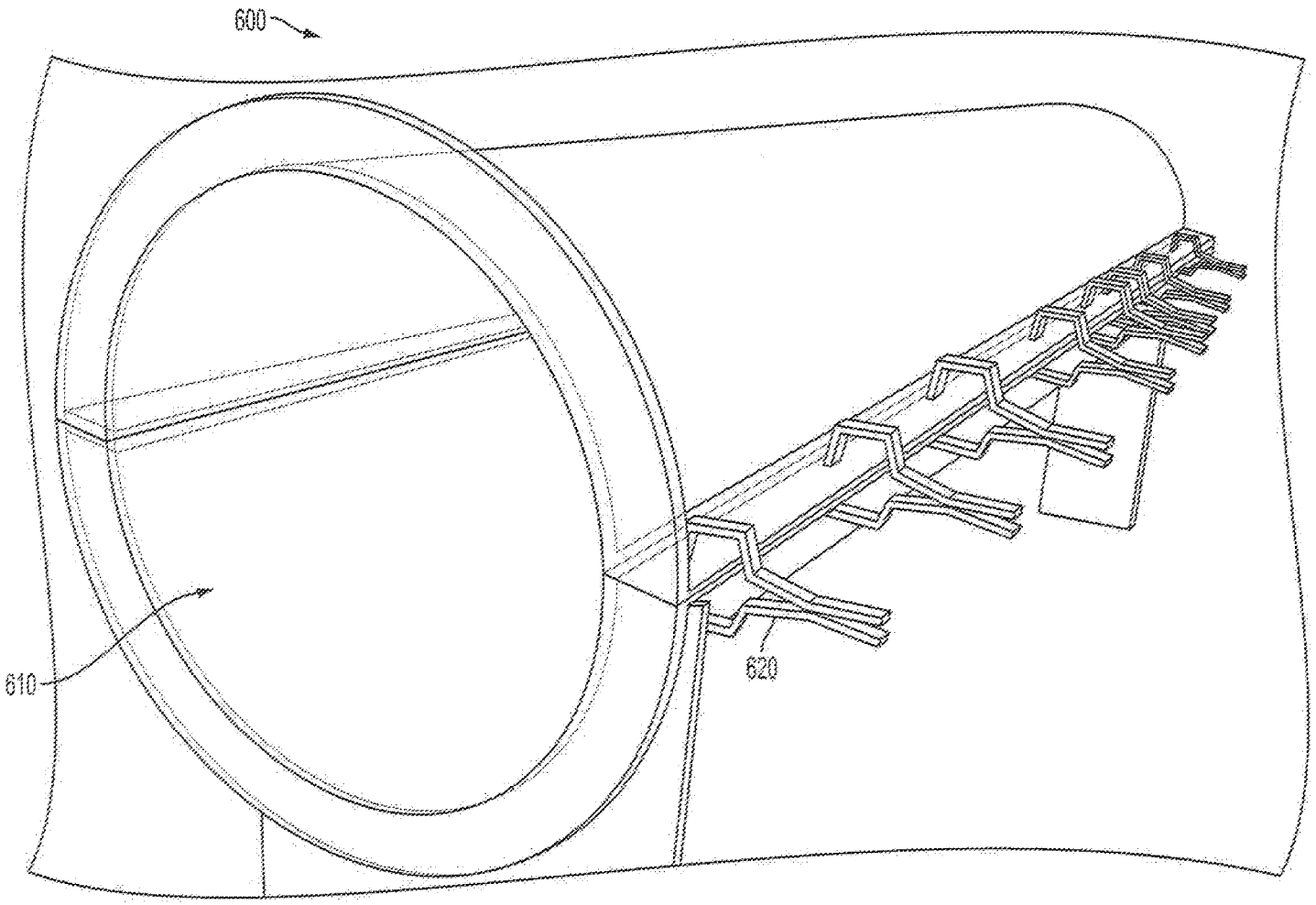
FIG. 6 illustrates a perspective view of a waterslide tube according to an embodiment of the present invention.

FIG. 6 illustrates a perspective view 600 of a waterslide tube. In some embodiments, the two clam-shells (300, 350) shown in FIGS. 3A-1 and/or 3A-2 may enclose and/or be fastened 620 around an existing waterslide tube 610. In this fashion, older waterslides without visual illumination and/or rider tracking/sensing as discussed elsewhere herein may be retrofitted with such new features.

In some other embodiments, one or more light strips can be integrated with the waterslide tube 600 to form a waterslide including visual illumination. For example, FIG. 5-1 illustrates a cross-sectional view of a waterslide tube 500 with integrated LED light strips 502 in accordance with some embodiments of the invention. Similar to the clam-shell half 300 shown in FIG. 3A-1, the inner and outer members as shown can be coupled to form an inner volume 510 that is isolated from the inner surface 503 of the inner member, so that any water contained on the inner surface 503 of the inner member is prevented from entering the inner volume 510. Moreover, in some embodiments, at least some portion of the inner volume 510 can form an illumination or display cavity. For example, as depicted in FIG. 5-1, in some embodiments, one or more light strips 502 can be distributed and attached to the inner surface 501 of the outer member within the inner volume 510. Some embodiments include at least a portion of the inner member that can comprise a material that is at least partially transparent or translucent to visible light so that at least some light emitted from one or more of the light strips 502 may pass through the inner member towards the inner portion 520 of the waterslide so as to be viewable by a rider. Moreover, in the embodiment depicted in FIG. 5-1, one or more light strips 502 can be distributed circumferentially so as to substantially surround a rider, and can be capable of displaying a 360° visual illumination to the rider as the rider is conveyed through the waterslide.

Figures 1, 5:
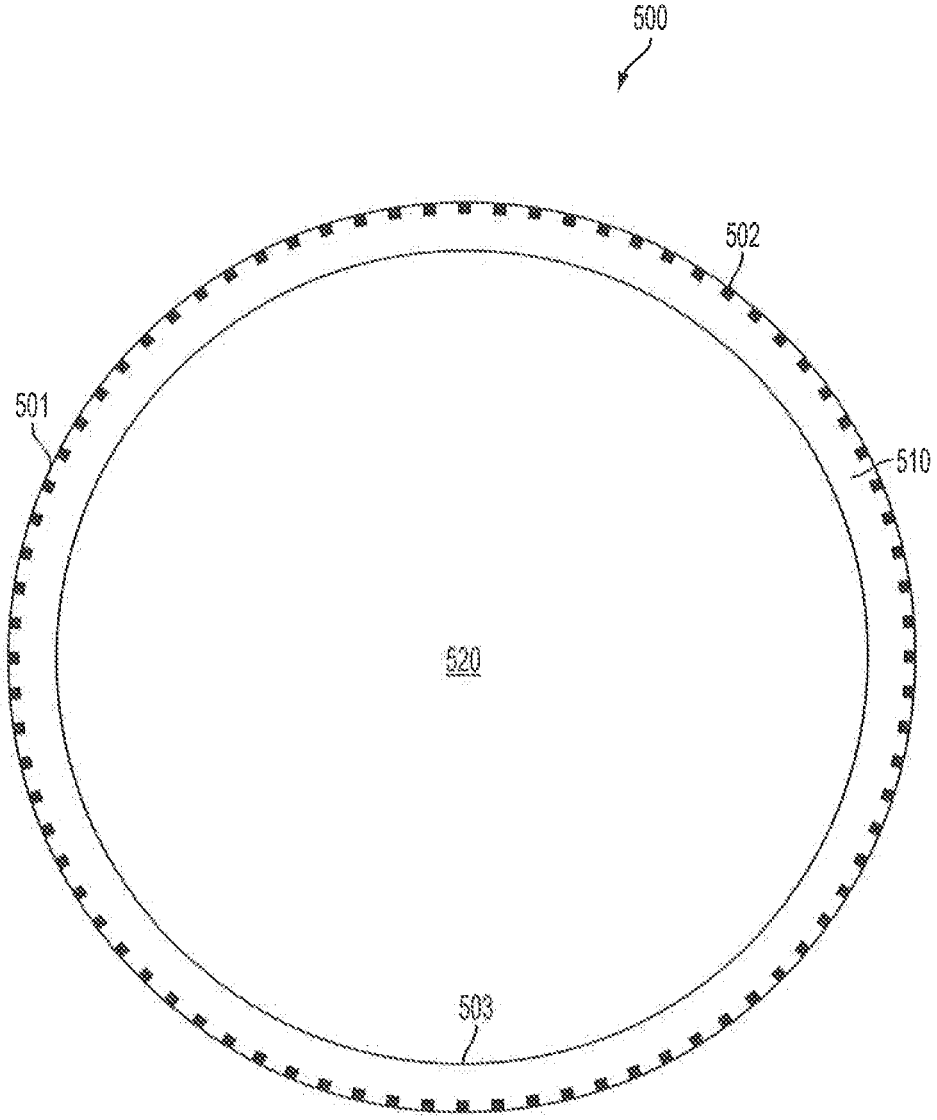
Figures 2, 5:
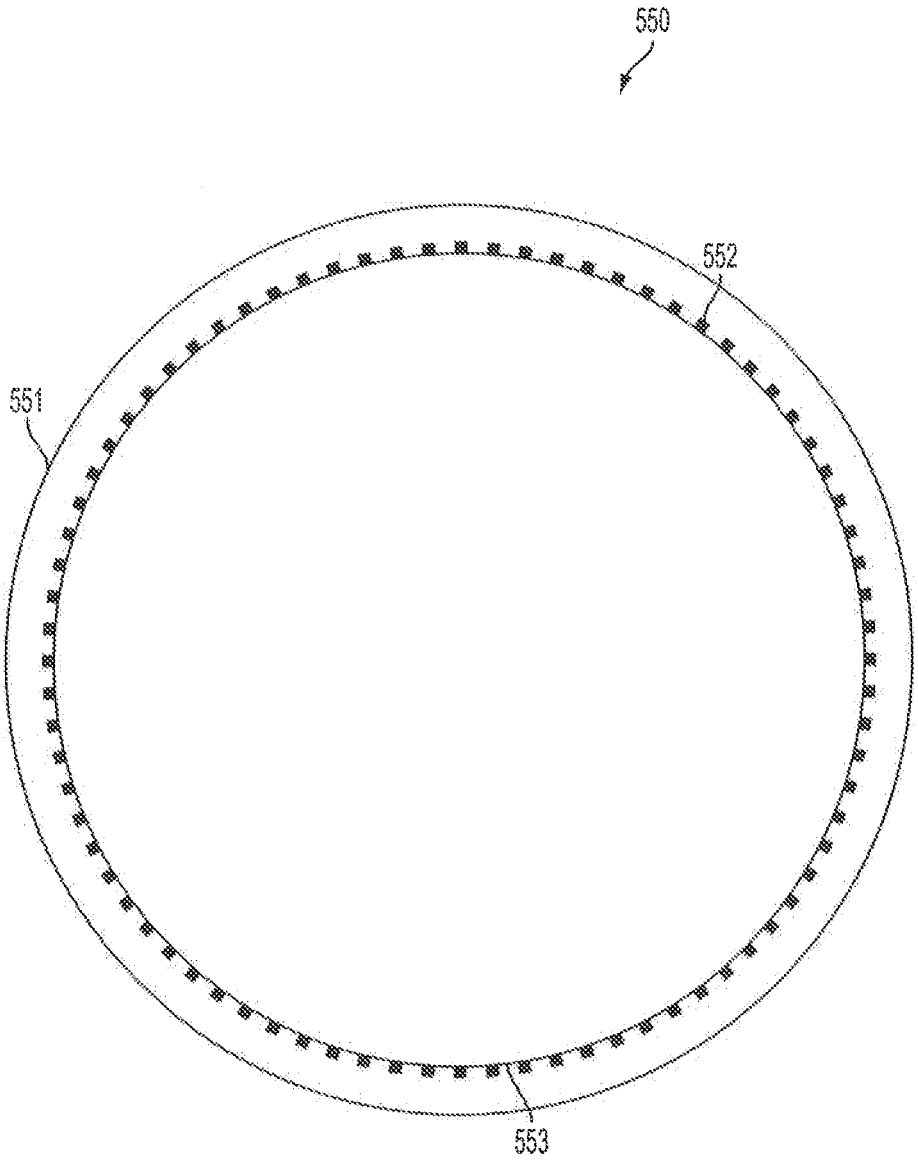

In some embodiments, the waterslide as depicted in FIG. 5-1 may comprise an inner member that can enable a rider to view direct, substantially un-diffused or substantially diffused illumination from one or more light strips distributed within the cavity.

In some embodiments, the light strips can be positioned and/or secured against the inner surface of the outer member of the chute (as illustrated in FIG. 5-1). The light strips can be positioned anywhere within the inner volume 510 or cavity. For example, in some other embodiments, such as the waterslide tube 550 of FIG. 5-2), light strips 552 can be positioned and/or secured against the outer surface 553 of the inner member. In some further embodiments (not shown), the light strips can be supported between the inner and outer members, embedded in the inner and/or outer members, or flush mounted to the inner surface 503 of the inner member. Flush mounting allows for maintenance to occur from within the chute. Some embodiments may include groups of light strips positioned in different locations within the cavity. For example, in some embodiments, one group of light strips can be positioned against the inner surface of the outer member, and a further group of light strips can be positioned against the outer surface of the inner member.

LED's can be relatively easily controlled and programmed, and in some embodiments, can be used to display at least one color, at least one image, at least one moving image translated from a video image, or a combination thereof. In some embodiments, each LED may comprise an image pixel. In other embodiments, an image pixel can be represented by multiple LED's. In some embodiments, each pixel can be individually controlled and each adjacent pixel can be individually controlled relative to each other individually controlled adjacent pixel. In some embodiments, the waterslide may include a visual display device capable of displaying 180 pixels wide by 160 pixels tall. In some embodiments, there can be more or fewer pixels comprising the display.

In some embodiments, a ride manager may control the illumination of one or more visual illumination devices using an LED mapping or other extension for ArKaos MediaMaster. The LED mapper extension allows the ride manager to import custom mapping of LED devices into MediaMaster and makes it possible to control many of them from a single MediaMaster server. MediaMaster allows mapping of a server's video output directly to any configuration of LED panels without using expensive hardware to convert the video signal. Pixel colors or intensity can be sent directly from a media server to the LED's. N.V. ArKaos S.A., N.V. ArKaos S.A. Software, the N.V. ArKaos S.A. logo, and "MEDIAMASTER" are trademarks of N.V. ArKaos S.A., Rhode-Saint-Genèse, Belgium. Additional of alternative LED mapping may be performed by other hardware and/or software in an alternative embodiment.

In some embodiments, one or more LED's or other lights can be illuminated in a pattern (e.g., in a chevron and/or triangle pattern or arrow pattern as discussed earlier, for example, with respect to FIGS. 1A and/or 1B). In some embodiments, the illuminated pattern may be lit for a specific period, and may subsequently be turned off for a specific period. Some embodiments include pulsating patterns. For example, in some embodiments, the illumination feature of a waterslide may include one or more patterns that pulsate (turn on and turn off with a defined frequency). In some embodiments, one or more LED's or other lights can be lit so that when combined, a specific color or combination of colors can be viewed by the rider. For example, in some embodiments, three closely positioned LED's comprising a red emitting LED, a blue emitting LED, and a green emitting LED can be lit in unison so that a rider may visually interpret a white pixel. In some further embodiments, other combinations of colors can be used.

Figure 7:
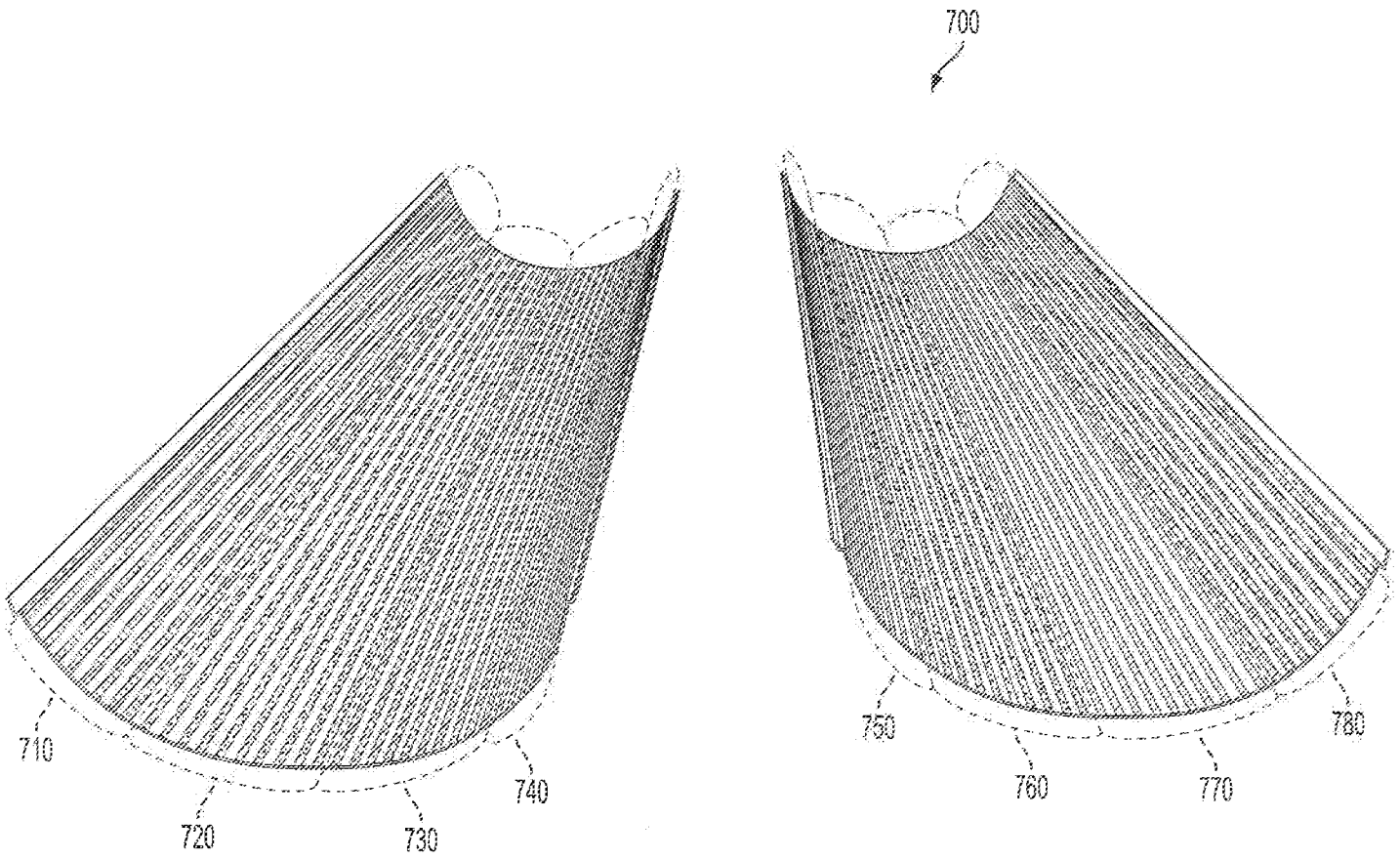
FIG. 7 illustrates perspective views of the two flume clam-shell halve sections shown in FIG. 4 with illuminated LED light strips according to an embodiment of the present invention.

FIG. 7 illustrates perspective views of two flume clam-shell half sections 700 (e.g., the same or similar to those shown in FIG. 4) with illuminated LED light strips in accordance with some embodiments of the invention. The clam-shell half sections 700 may be configured to show discrete sections of colors (e.g., four or more colors). For example, a first section 710 may display a first color, a second section 720 may display a second color, a third section 730 may display a third color, and a fourth section 740 may display a fourth color. Likewise, a fifth section 750 may display the first color, a sixth section 760 may display the second color, a seventh section 770 may display the third color, and an eighth section 780 may display the fourth color. Any of a variety of and/or number of colors and/or sections may be utilized in an alternative embodiment.

Figure 8:
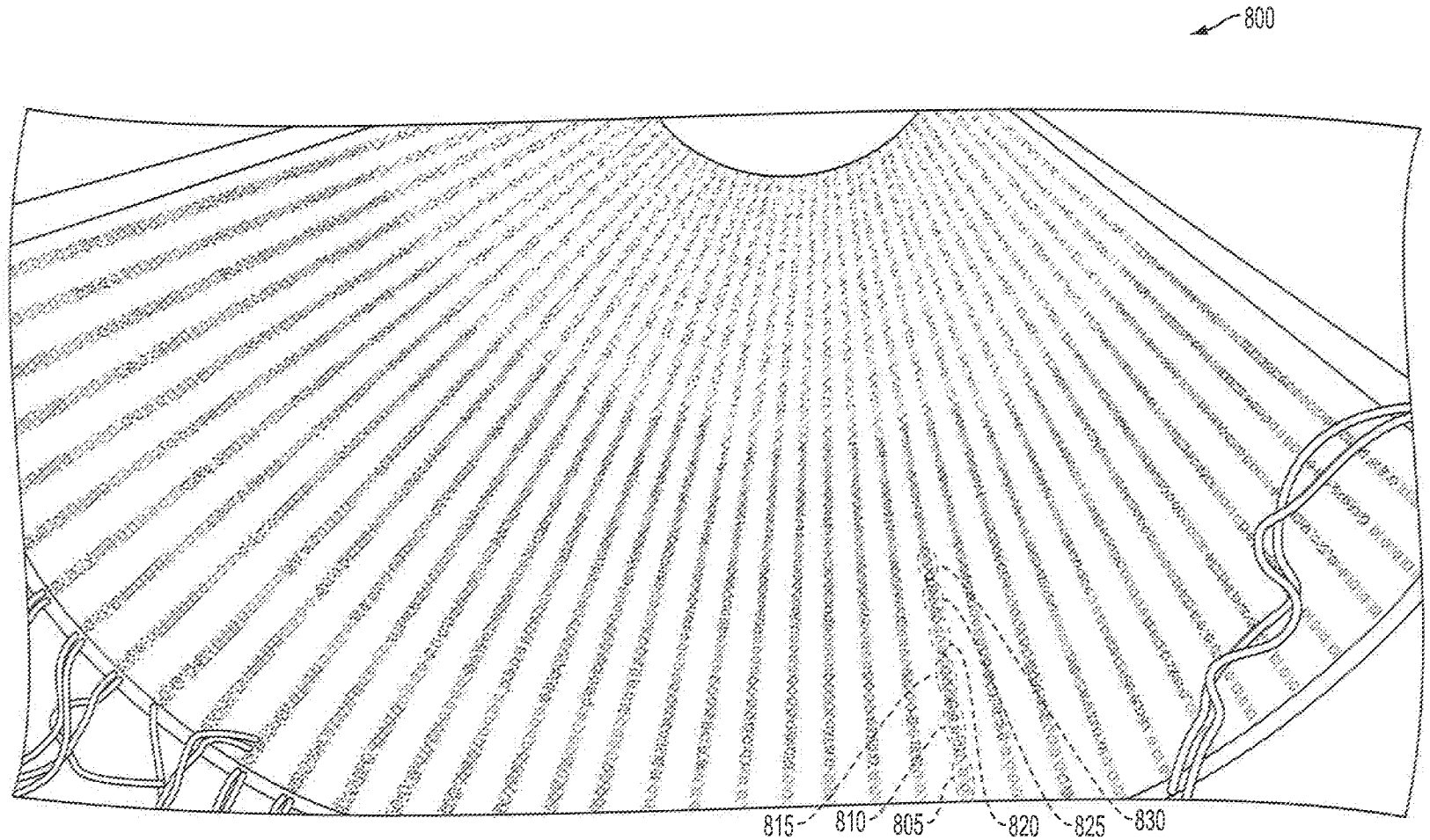
FIG. 8 illustrates an inner perspective view of a flume clam-shell section shown in FIG. 3B with illuminated LED light strips according to an embodiment of the present invention.

FIG. 8 illustrates an inner perspective view of a flume clam-shell section 800 (such as the one shown in FIG. 3B) with illuminated LED light strips in accordance with some embodiments of the invention. As shown, the LED light strips can include groups of colors, with each color group extending circumferentially around the clam-shell and periodically repeated down the length of the clam-shell. For example, a first group of lights 805 may be a first color, a second group of lights 810 may be a second color, and a third group of lights 815 may be a third color. Likewise, a fourth group of lights 820 may be the first color, a fifth group of lights 825 may be the second color, and a sixth group of lights 825 may be the third color.

Figure 9A:
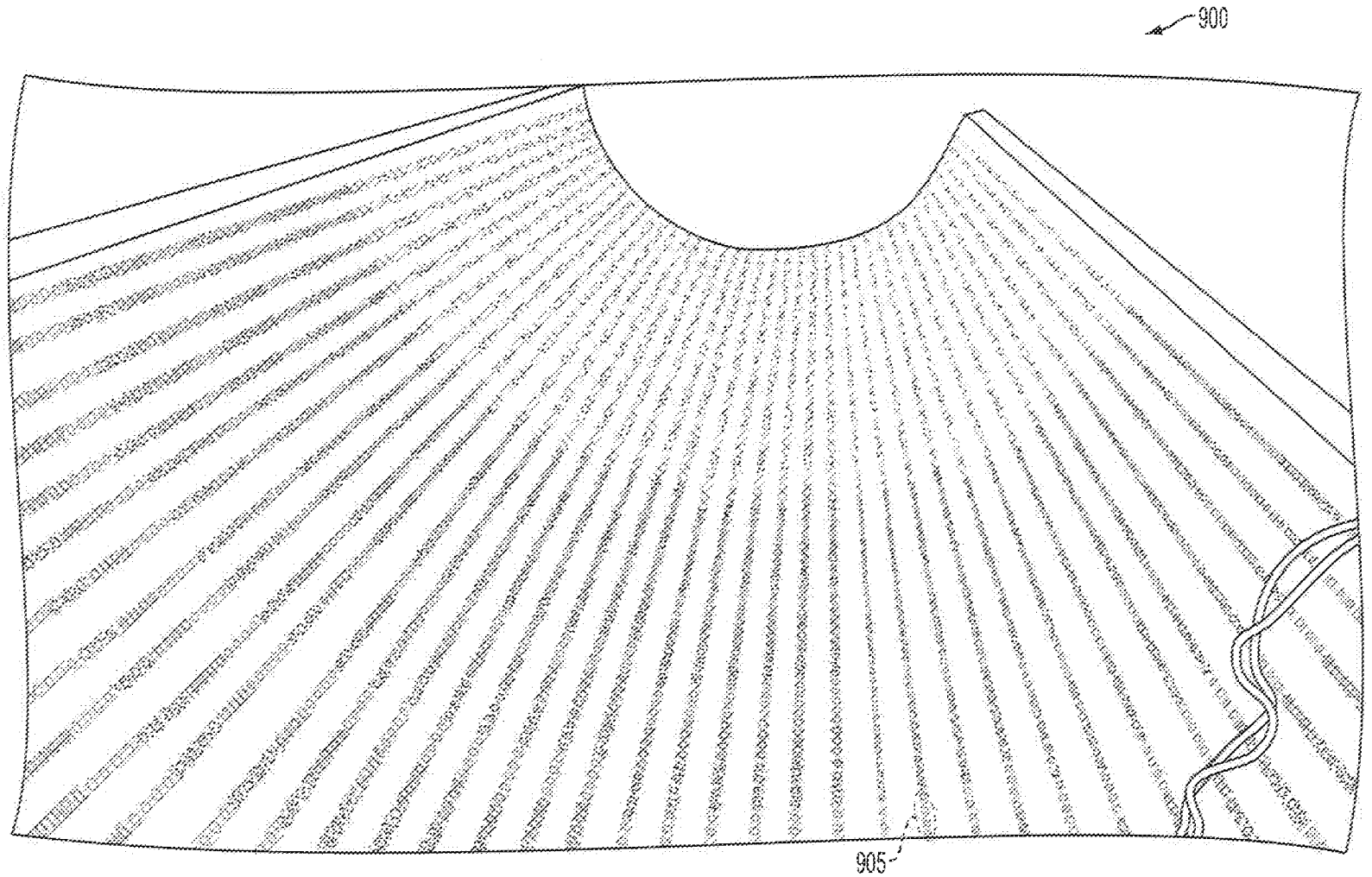
FIG. 9A illustrates an inner perspective view of a flume clam-shell section shown in FIG. 3B with LED light strips illuminating a first light pattern according to an embodiment of the present invention.
Figure 9B:
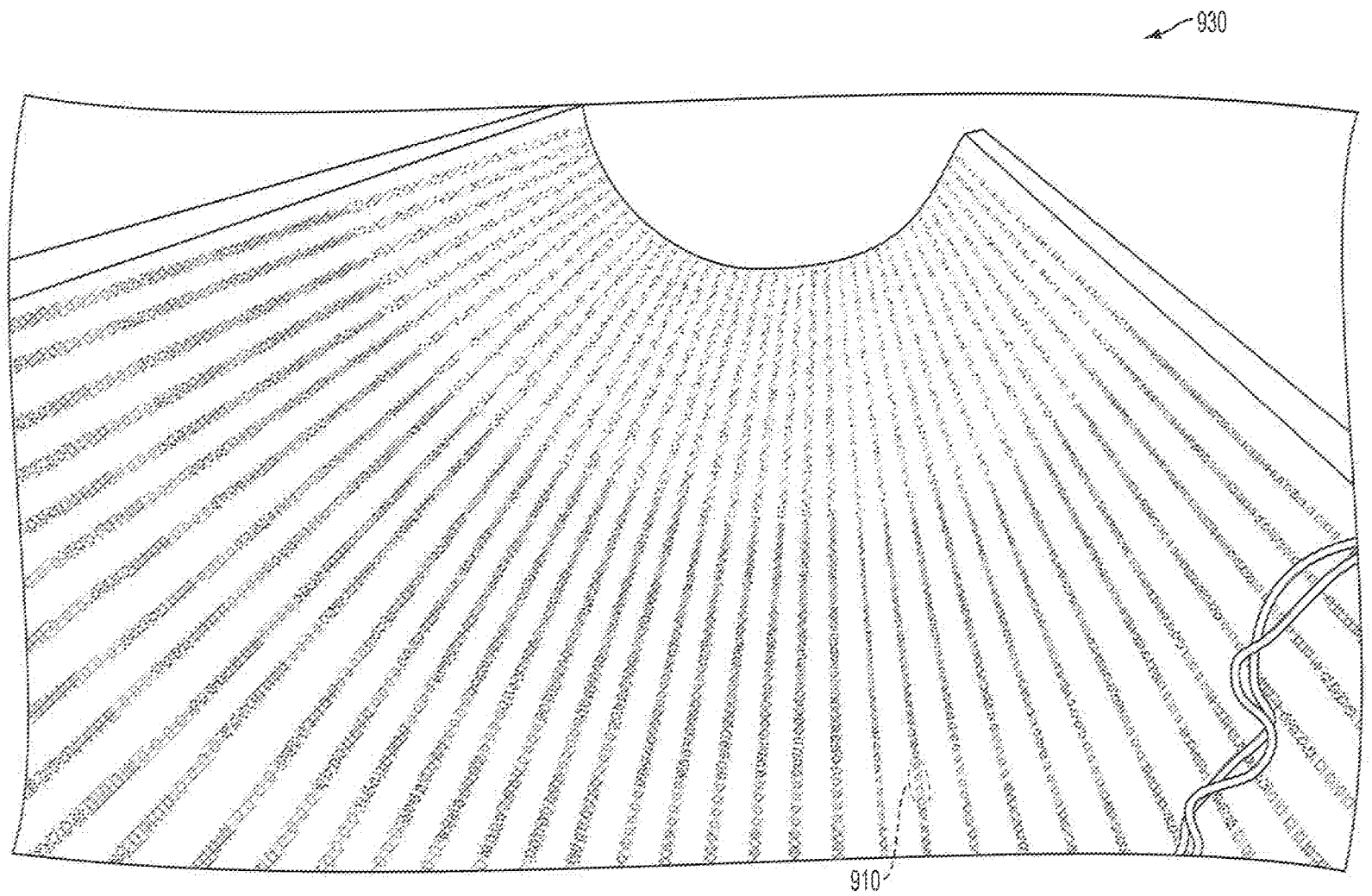
FIG. 9B illustrates an inner perspective view of a flume clam-shell section shown in FIG. 3B with LED light strips illuminating a second light pattern according to an embodiment of the present invention.
Figure 9C:
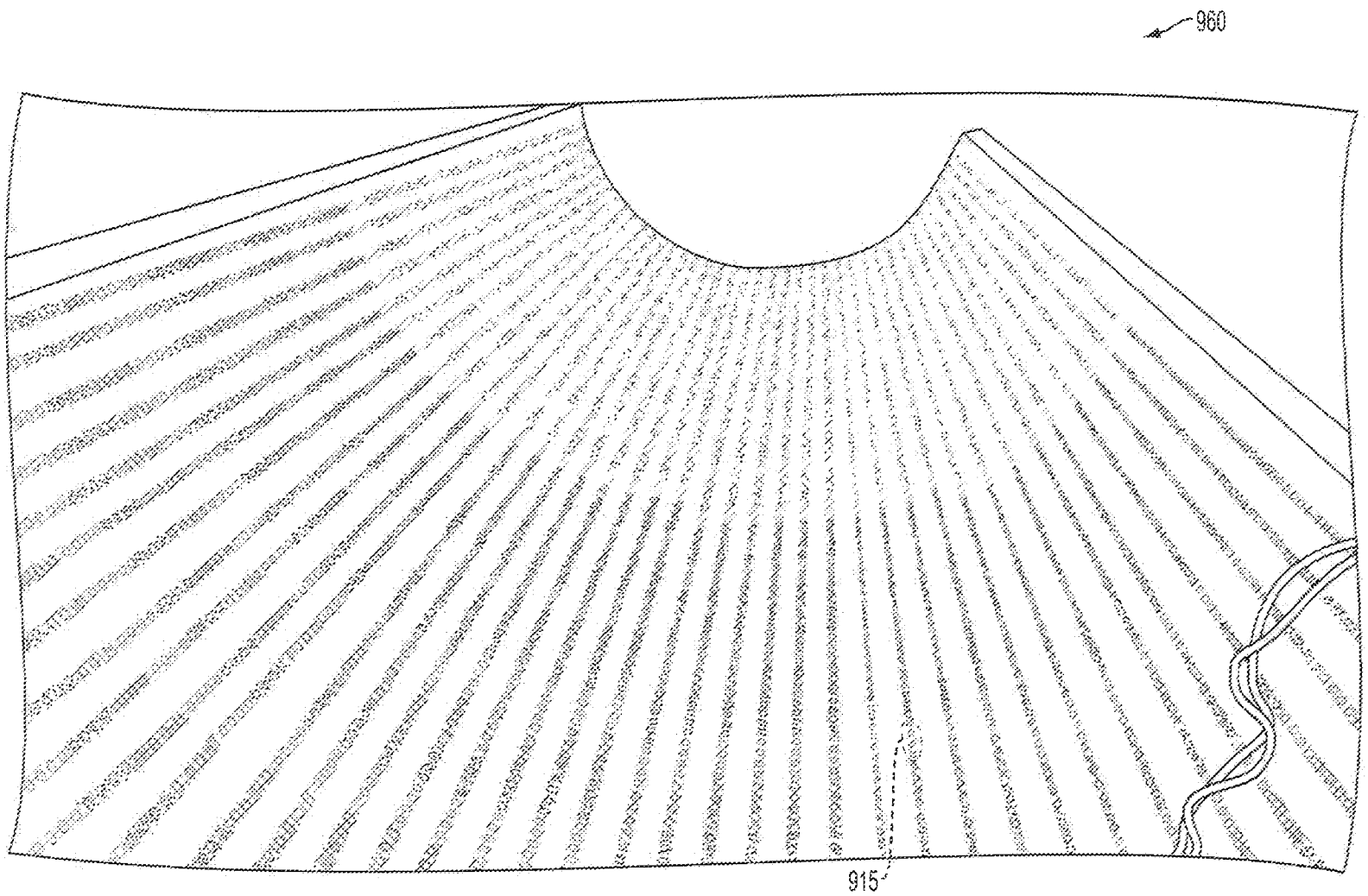
FIG. 9C illustrates an inner perspective view of a flume clam-shell section shown in FIG. 3B with LED light strips illuminating a third light pattern according to an embodiment of the present invention.

Some embodiments of the invention may comprise a waterslide including at least one animated visual illumination. For example, in some embodiments, one or more LED's forming at least one illuminated pattern can be lit for a specific period, and may subsequently be turned off for a specific period. After a specific period of time (usually less than a few seconds), a substantially similar pattern can be illuminated using one or more of the previously illuminated LED's and at least one adjacent LED, or using other LED's adjacent to or near the previously lit LED's. Using this method, a pattern can be made to appear to move over the waterslide in any direction. For example, FIG. 9A illustrates an inner perspective view of a flume clam-shell section 900 (such as one shown in FIG. 3B) with LED light strips illuminating a first light pattern in accordance with some embodiments of the invention. A first set of lights 905 is initially illuminated and/or illuminated as a particular color. FIG. 9B illustrates an inner perspective view of a flume clam-shell section 930 (such as one shown in FIG. 3B) with LED light strips illuminating a second light pattern in accordance with some embodiments of the invention. A second set of lights 910 is now illuminated and/or illuminated as the same color previously illuminated for the first set of lights 905. Further, FIG. 9C illustrates an inner perspective view of a flume clam-shell section 960 (such as one shown in FIG. 3B) with LED light strips illuminating a third light pattern in accordance with some embodiments of the invention. A third set of lights 915 is now illuminated and/or illuminated as the same color previously illuminated for the second set of lights 910. In this instance, the color groups can be shown to have appeared to have shifted along the axial length of the waterslide. The speed and/or direction at which the lights appear to shift or move may be used to simulate speed for a rider and/or may be used to animate any of a variety of images displayed to the user.

In some other embodiments, the visual illumination may comprise a static animation. For example, in some embodiments, one or more patterns can be displayed which can be switched to a different pattern in the same location. Using the example shown in FIGS. 1A and 1B, in some embodiments, one or more of the arrows can be animated (e.g., by illuminating the head portion of the arrow intermittently, or by displaying an arrow that appears to grow larger, change color or shift towards the sensor).

In some embodiments, the speed of animation (i.e., the speed of movement or rate of change) of one or more illuminated patterns may change. In some embodiments, the rate of change of one or more patterns may enable the display of at least one video. For example, in some embodiments, videos can be relayed and one or more LED's can be turned on and off based on video signal. In some embodiments, the waterslide may display a video translated from a movie file such as a .mov file, an .avi file, or an mpeg4 file, etc. In some embodiments, the video source may comprise a video sourced from a computer (e.g., from the ride manager's computer or computer server or from another computer connected to the ride manager's computer). In some embodiments, the video can be displayed on the waterslide based on a wirelessly transferred video. In some embodiments, the video can be sourced from an Internet service, such as YouTube™, or another streaming service across a public or private network. YouTube is a registered trademark of Google, Inc.

Some embodiments of the invention include a simulated water and/or under-water scene. For example, in some embodiments, one or more patterns can be displayed on the waterslide that may include at least one scene or image (e.g., a submarine, giant attacking squid, a shark, etc.) that may cause a rider to form a belief that he or she is submerged in water. For example, in some embodiments, an under-water river or lake scene can be displayed to the rider. In other embodiments, the visual illumination from the waterslide may simulate an underwater ocean scene (e.g., a deep ocean scene with colorful moving fish and/or a coral reef scene). In some embodiments computer-animated fish or other computer-animated objects within the displayed scene may "react" to the rider based on one or more feedbacks provided by the various sensors and user interactions as described herein.

In some embodiments, at least one portion of a waterslide can be coupled with a disc-jockey and/or media control system to create live lighting effects. For example, in some embodiments, a disc-jockey may purposefully manipulate a visual illumination of at least one waterslide based on a music theme, a music album or music single, a music video, or a live band. In some embodiments, the disc-jockey may control visual illumination emitted from at least some portion of the waterslide based at least in part on an audio input. For example, in some embodiments, at least one portion of the waterslide, and/or at least one light strip and/or at least one LED can be lit to at least display a color, change a color, pulsate a color, animate a pattern, or modulate a brightness based at least in part on an audio input generated by at least one musical instrument, at least one band member, at least one disc-jockey, or a combination thereof. The disc-jockey may be a ride operator, manipulating the visual illumination in real time or per a pre-recorded set of steps. In an alternative embodiment, the disc-jockey may be software-based or otherwise automated.

In some embodiments, multiple portions of the waterslide can be visually manipulated at the same time. In some embodiments, specific portions of the waterslide can be visually manipulated based on various factors including but not limited to the speed of the rider, the incline angle of the waterslide, the width of any portion or segment of the waterslide, the water flow rate, the actual speed of the rider at any moment, the riders average speed since entering the waterslide, the rider's skill, the number of riders, the age of the rider, the rider's gender, and so on.

In some embodiments, at least one portion of water slide may include a visual illumination that is controlled by one or more rider's actions (whether intentional or unintentional) in the waterslide. For example, in some embodiments, a rider may pass by or intentionally actuate a sensor (e.g., the sensor with visual indication 122 such as green arrow for telling the user 102 to move the sensor 110 and/or tag discussed earlier and shown in FIG. 1A). In other embodiments, an intentional or unintentional position or pose of a rider may change or influence the visual appearance of any portion of the waterslide.

In some embodiments, at least one portion of a water slide may include a visual illumination that is controlled by a rider's emotion and/or visual appearance. For example, in some embodiments, a conventional camera system may enable a ride manager or a machine algorithm to determine the rider's emotion based on a physical position or appearance of the rider, including, but not limited to a rider's facial expression.

Some embodiments include at least one portion of water slide that may include a visual illumination that is controlled by a bystander (e.g., at least one friend or colleague of the rider). In this instance, the bystander may manipulate the visual illumination of the waterslide from within the facility in which the waterslide is housed (i.e., a water park or theme park), or alternatively, from a remote location (i.e., from a bystander's computer, laptop, tablet, smartphone, or other mobile device that can be within the facility or outside of the facility).

In some embodiments, at least one portion of a water slide may include a visual illumination coupled to a connected water-park attraction. For example, in some embodiments, one or more light strips can be controlled by a connected system that includes at least one other controllable system with the water park. In some embodiments for example, a water park may include a theme such as a current party theme and at least one portion of water slide may include a visual illumination that can be controlled in at least in part based on the theme.

Some embodiments of the invention may include a waterslide with at least one portion including a visual illumination capable of visually interacting with a color reflector, color absorber, or light sensor within the waterslide. For example, in some embodiments, at least one portion including a visual illumination may illuminate a reflective region, badge, tag or light sensor worn by at least one rider. In some other embodiments, at least one of the at least one portion including a visual illumination may illuminate at least one waterborne object not attached to the rider such as a submerged light sensor, material added to the water such as light reflective glitter, or simulated fish, and so on.

In some embodiments of the invention, one or more segments of a waterslide, for example, those depicted in FIGS. 1A-1B, 2A-2C, 3A-3B, 4-9, and 9A-9C can comprise a transparent or translucent region, such as a glass, or plastic or fiberglass portion that is at least partially light transmitting. As discussed earlier, in some embodiments, at least some portion of the waterslide can be, for example, some transparent, semi-transparent or translucent material, including acrylic (polymethyl-methacrylate) based polymers, butyrate (cellulose acetate butyrate) based polymers, polycarbonate based polymers, and glycol modified polyethylene terephthalate based polymers, or mixtures thereof. Further, some portions of the waterslide may comprise a fiberglass-based material, including, for example, a fiberglass-resin based composite material.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

What is claimed is:

1. A waterslide comprising:

a closed tube having a translucent member and an outer member adjacent to the translucent member, at least a portion of the translucent member configured to support a flow of water thereon;

at least one light strip coupled with the outer member and configured to illuminate through the translucent member;

a button configured to be pressed by a rider for providing rider feedback; and a processor in communication with the at least one light strip and configured to control the at least one light strip in response to the rider feedback.

2. The waterslide of claim 1 wherein the at least one light strip includes a plurality of Light Emitting Diodes ("LEDs").

3. The waterslide of claim 1 wherein the at least one light strip includes multiple light strips arranged parallel to one another, each of the multiple light strips configured to illuminate through the translucent member.

4. The waterslide of claim 1 wherein the at least one light strip is coupled to the translucent member via a connector.

5. The waterslide of claim 1 wherein the at least one light strip is coupled with the outer member via embedding within the outer member.

6. The waterslide of claim 1 wherein the at least one light strip is configured to communicate wirelessly with the processor.

7. The waterslide of claim 1 wherein the at least one light strip is configured to communicate via one or more wires with the processor.

8. The waterslide of claim 1 wherein the processor is in wireless communication with the button for detecting the rider feedback.

* * * * *